US008745959B2

(12) United States Patent
Strickland et al.

(10) Patent No.: US 8,745,959 B2
(45) Date of Patent: Jun. 10, 2014

(54) LIGHT STEEL STRUCTURAL STUD

(75) Inventors: Michael R. Strickland, Richmond Hill (CA); Douglas M. Fox, Kitchener (CA); Richard W. Strickland, Richmond Hill (CA)

(73) Assignee: Paradigm Focus Product Development Inc., Richmond Hill, ON (CA)

( * ) Notice: Subject to any disclaimer, the term of this patent is extended or adjusted under 35 U.S.C. 154(b) by 0 days.

(21) Appl. No.: 13/550,438

(22) Filed: Jul. 16, 2012

(65) Prior Publication Data

US 2012/0279162 A1 Nov. 8, 2012

Related U.S. Application Data

(62) Division of application No. 11/802,104, filed on May 18, 2007, now Pat. No. 8,225,581.

(60) Provisional application No. 60/801,055, filed on May 18, 2006.

(51) Int. Cl.
*E04C 3/00* (2006.01)

(52) U.S. Cl.
USPC ..... 52/850; 52/481.1; 52/855

(58) Field of Classification Search
USPC ..... 52/481.1, 831, 846, 842, 850–852
See application file for complete search history.

(56) References Cited

U.S. PATENT DOCUMENTS

| | | | | |
|---|---|---|---|---|
| 881,355 A | | 3/1908 | Turnbull | |
| 1,077,404 A | | 11/1913 | Goldsmith | |
| 1,820,700 A | | 8/1931 | Hatch | |
| 2,108,373 A | | 2/1938 | Greulich | |
| 3,043,408 A | * | 7/1962 | Attwood | 52/842 |
| 3,852,935 A | | 12/1974 | Jones | |
| 4,011,704 A | | 3/1977 | O'Konski | |
| 4,016,700 A | | 4/1977 | Blomstedt | |
| 4,329,824 A | * | 5/1982 | Lowe | 52/634 |
| 4,455,806 A | | 6/1984 | Rice | |

(Continued)

FOREIGN PATENT DOCUMENTS

| | | |
|---|---|---|
| CA | 2502115 | 5/2006 |
| GB | 2171731 | 9/1986 |

(Continued)

OTHER PUBLICATIONS

C.Y. Lin. Axial Capacity of Concrete Filled Cold-Formed Steel Columns. Ninth International Specialty Conference on Cold-Formed Steel Structures. St. Louis, Missouri. USA. pp. 443-457. Nov. 8-9, 1988.

(Continued)

*Primary Examiner* — William Gilbert
(74) *Attorney, Agent, or Firm* — Hill & Schumacher

(57) ABSTRACT

A light steel structural stud includes a web portion, a pair of flanges and a pair of flange lips. The web portion has a web face and sides. The pair of flange portions each extend generally orthogonally from each side of the web portion. Each flange portion is in a plane that is generally parallel to the plane of the other flange portion. Each of the flange portions has a flange face. The pair of flange lips each extend generally orthogonally from each of the flange portions and are generally parallel to the web portion. Each flange lip has a double thickness and at least a portion of each flange portion has a double thickness.

42 Claims, 39 Drawing Sheets

(56) References Cited

U.S. PATENT DOCUMENTS

| | | | | | |
|---|---|---|---|---|---|
| 4,783,940 | A | | 11/1988 | Sato | |
| 4,793,113 | A | | 12/1988 | Bodnar | |
| 4,962,622 | A | | 10/1990 | Albrecht | |
| 4,986,051 | A | | 1/1991 | Meyer | |
| 5,157,883 | A | * | 10/1992 | Meyer | 52/357 |
| 5,285,615 | A | | 2/1994 | Gilmour | |
| 5,527,625 | A | * | 6/1996 | Bodnar | 428/595 |
| 5,687,538 | A | | 11/1997 | Frobosilo et al. | |
| 5,689,990 | A | | 11/1997 | Deeley | |
| 6,073,414 | A | | 6/2000 | Garris | |
| 6,183,879 | B1 | | 2/2001 | Deeley | |
| 6,481,175 | B2 | | 11/2002 | Potter et al. | |
| 6,647,675 | B1 | * | 11/2003 | Castellanos | 52/198 |
| 2005/0081477 | A1 | * | 4/2005 | St. Quinton | 52/720.1 |
| 2006/0191236 | A1 | * | 8/2006 | Surowiecki | 52/733.3 |

FOREIGN PATENT DOCUMENTS

| | | |
|---|---|---|
| WO | 8101582 | 6/1981 |
| WO | 2004113637 | 12/2004 |
| WO | 2005042869 | 5/2005 |

OTHER PUBLICATIONS

Halmos, George. Editor. Roll Forming Handbook. Taylor & Francis Group. p. 1. Nov. 29, 2005.

* cited by examiner (a)

(b)

(c)

(d)

LIGHT STEEL STRUCTURAL STUD

CROSS REFERENCE TO RELATED PATENT APPLICATION

This patent application is a divisional application that relates to U.S. patent application Ser. No. 11/802,104 filed on May 18, 2007 entitled Light Steel Structural Members and also related to U.S. Provisional Application Ser. No. 60/801,055 filed on Dec. 22, 2006 entitled Structural Stud.

FIELD OF THE DISCLOSURE

This disclosure relates to structural members and in particular structural members made from light steel and structural members made from light steel and concrete.

BACKGROUND OF THE DISCLOSURE

For the construction of buildings Light Steel Framed (LSF) structures have been gaining acceptance in various segments of the construction market. The C-Shape section has gained its greatest acceptance in wall applications, primarily as exterior curtain and wind wall applications and for interior partition walls. For high structural gravity loads and spanning wall openings C-Shapes are often thicker to suit increased loads. On multi-floor LSF buildings C-Shapes are bunched and connected together to suit high loads. For lateral building stability the C-Shape bracing connections can be three material layers thick at the top and bottom of the wall structure, which causes unsightly bumps to prevail in the finished gypsum and sheathing applications. While light steel framing is superior in quality to wood for structural applications, steel has a high thermal conductance capability that causes steel in contact with the exterior sheathing to suck in exterior temperatures that are different than the interior temperature.

Accordingly it would be advantageous to provide a structural member that improves structural and building science performance of the metal wall member while reducing material use thereby reducing cost of material while providing an improved product. Further, it would be advantageous to provide a structural member that improves structural capacity. This would enable a designer to develop wall systems with improved fire resistance values for LSF structures. Further it would be advantageous to provide light metal members that may form part of the wall system. Still further, it would be advantageous if the wall system goes together more easily and can be easily customized. A further enhancement of the structural steel member would be to provide a bridging that restrains the member from twisting and requires less fasteners to fix and make solid.

SUMMARY

A light steel structural stud includes a web portion, a pair of flanges and a pair of flange lips. The web portion has a web face and sides. The pair of flange portions each extend generally orthogonally from each side of the web portion. Each flange portion is in a plane that is generally parallel to the plane of the other flange portion. Each of the flange portions has a flange face. The pair of flange lips, each extend generally orthogonally from each of the flange portions and are generally parallel to the web portion. Each flange lip has a double thickness and at least a portion of each flange portion has a double thickness.

In another aspect of the disclosure a plurality of light steel structural studs are used in a light steel structural system.

Further features will be described or will become apparent in the course of the following detailed description.

BRIEF DESCRIPTION OF THE DRAWINGS

The embodiment will now be described by way of example only, with reference to the accompanying drawings, in which.

DETAILED DESCRIPTION

Figure 1:
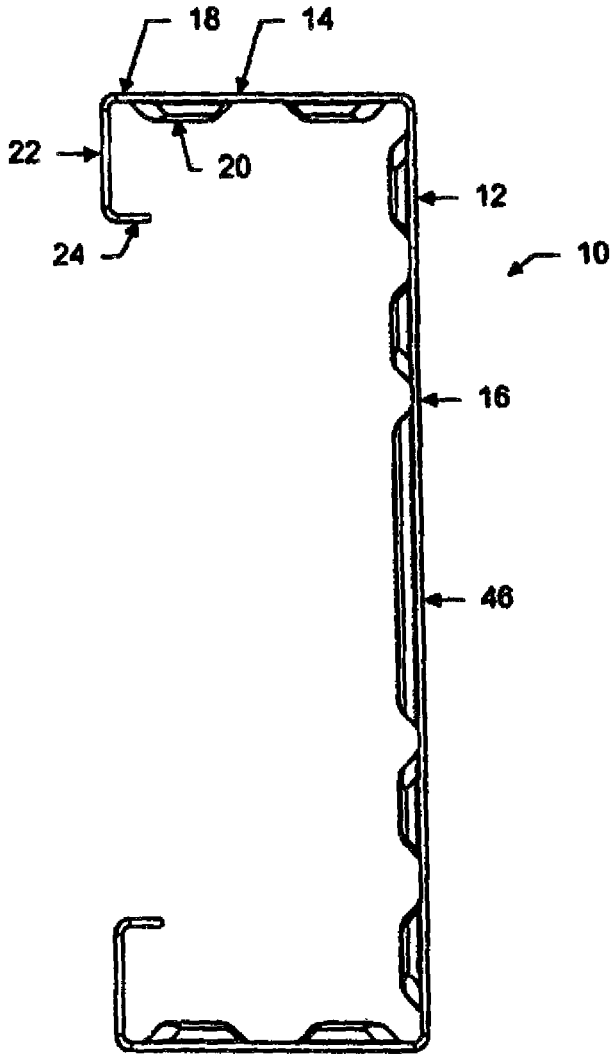
FIG. 1 is a cross sectional view of the light steel structural member of the present embodiment.

Referring to figures, FIG. 1 shows the light steel structural member of the present embodiment generally at 10. The light steel structural member 10 includes a web portion 12 and a pair of flange portions 14. The web portion has a web face 16. The pair of flange portions 14 each extend generally orthogonally from each end of the web portion 12. The flange portions 14 are generally parallel to each other. Each flange portion 14 has a flange face 18. At least one of the web face 16 and the flange face 18 has a plurality of embosses 20 formed therein. Preferably member 10 also includes a pair of flange lips 22 extending inwardly from flange 14. The flange lips 22 extend generally orthogonally from each flange generally parallel to the web 12. A flange lip stiffener 24 which extends inwardly from flange lips 22 may also be used to further improve the structural characteristics of the member 10.

Figure 2:
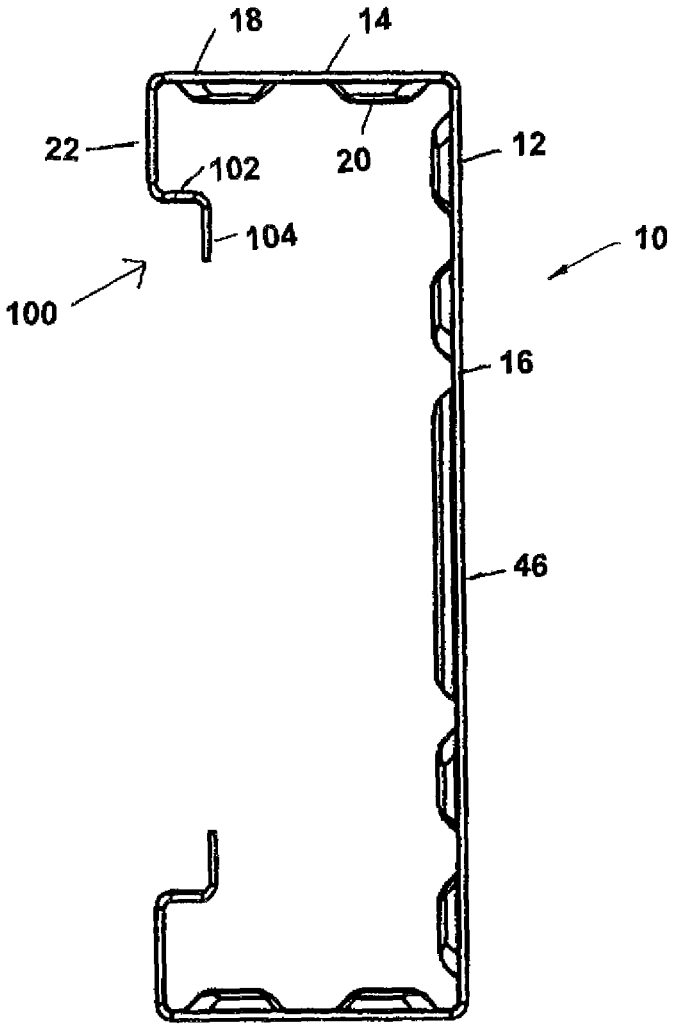
FIG. 2 is a cross sectional view of another embodiment of the light steel structural member of the present embodiment similar to that shown in FIG. 1 but showing a multi-cranked stiffener added to the flange lip.
Figure 3:
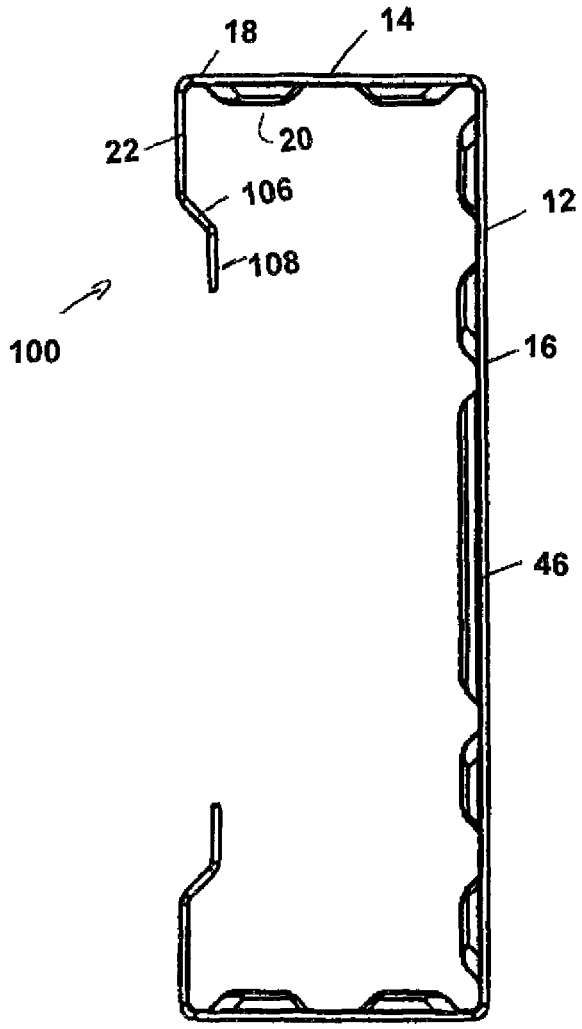
FIG. 3 is a cross section view of a further embodiment of the light steel structural member of the present embodiment similar to that shown in FIG. 2 but showing another embodiment of the multi-cranked stiffener.

FIGS. 2 and 3 show another variation in regard to the flange portion 14 including a multi-cranked stiffener 100. Multi-cranked stiffeners 100 can be provided in a number of different configurations. Two configurations are shown in FIGS. 2 and 3. FIG. 2 shows a multi-cranked stiffener that includes a first portion 102 that is generally orthogonal to lip 22 and a second portion 104 that is generally orthogonal to the first portion 102. FIG. 3 shows an alternate configuration wherein the multi-cranked stiffener 100 includes a first portion 106 that is angled inwardly from the lip 22 and a second portion 108 that is spaced inwardly from the lip 22 and in a plane that is generally parallel to the plane of lip 22. The multi-cranked stiffener 100 added to the lip 22 increases the lips' plate buckling stiffness, thus reducing the effects of local buckling.

With the appropriate apportioning of materials, the moment of inertia of the lip 22 and lip stiffener 24 combination is made larger than that of a lip alone, thus increasing its ability to stiffen the flange against distortional buckling. The result of increased local and distortional buckling resistance is increased member strength for the same weight. As a corollary, one can say that the addition of a multi-cranked stiffener to the lip can result in the same strength with less material than a similar section without the lip stiffener.

Figure 4:
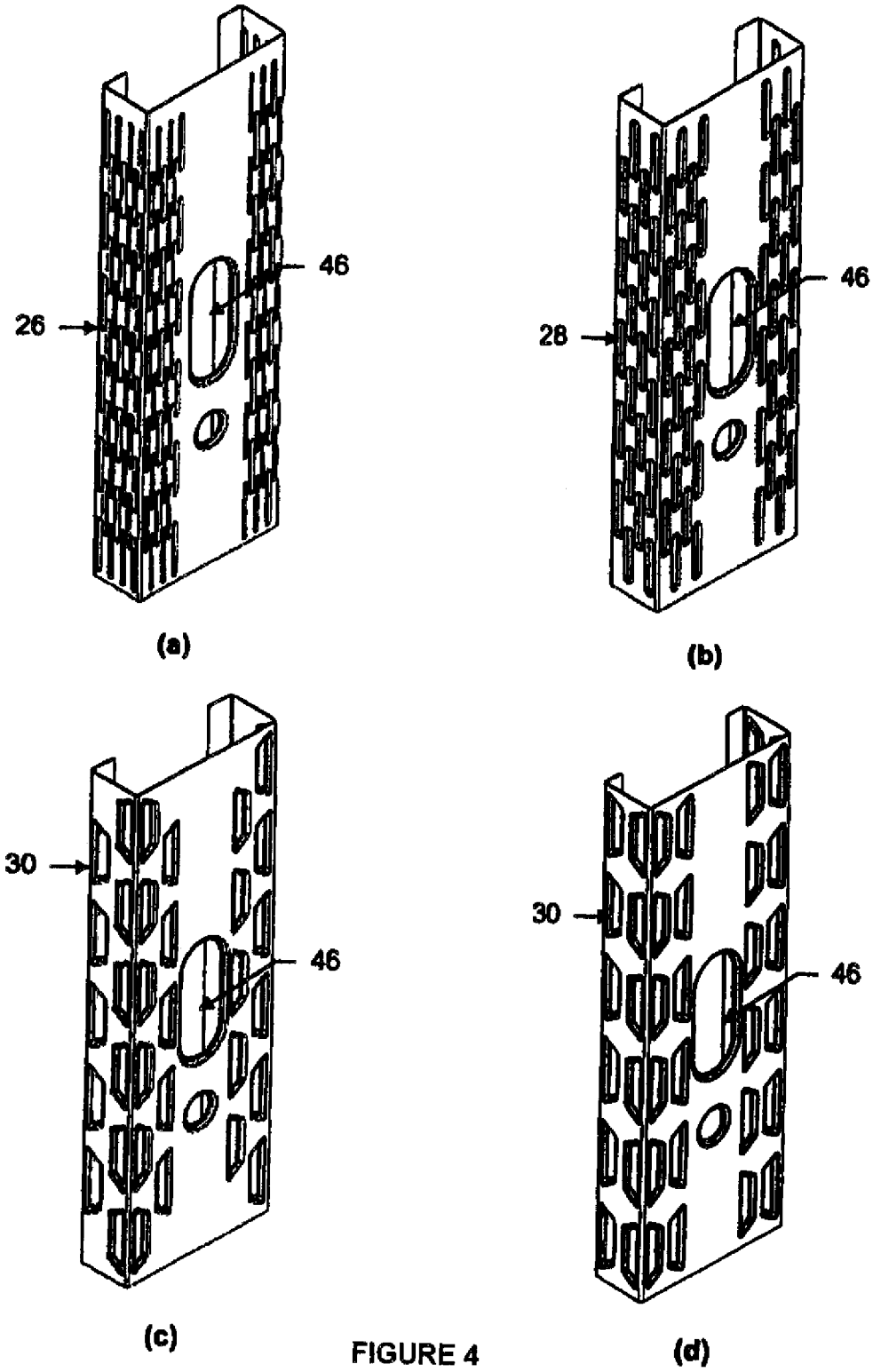
FIG. 4 (*a*) to (*d*) are perspective views of four alternate embodiments of the light steel structural member of the present embodiment showing alternate shaped embossments.
Figure 5:
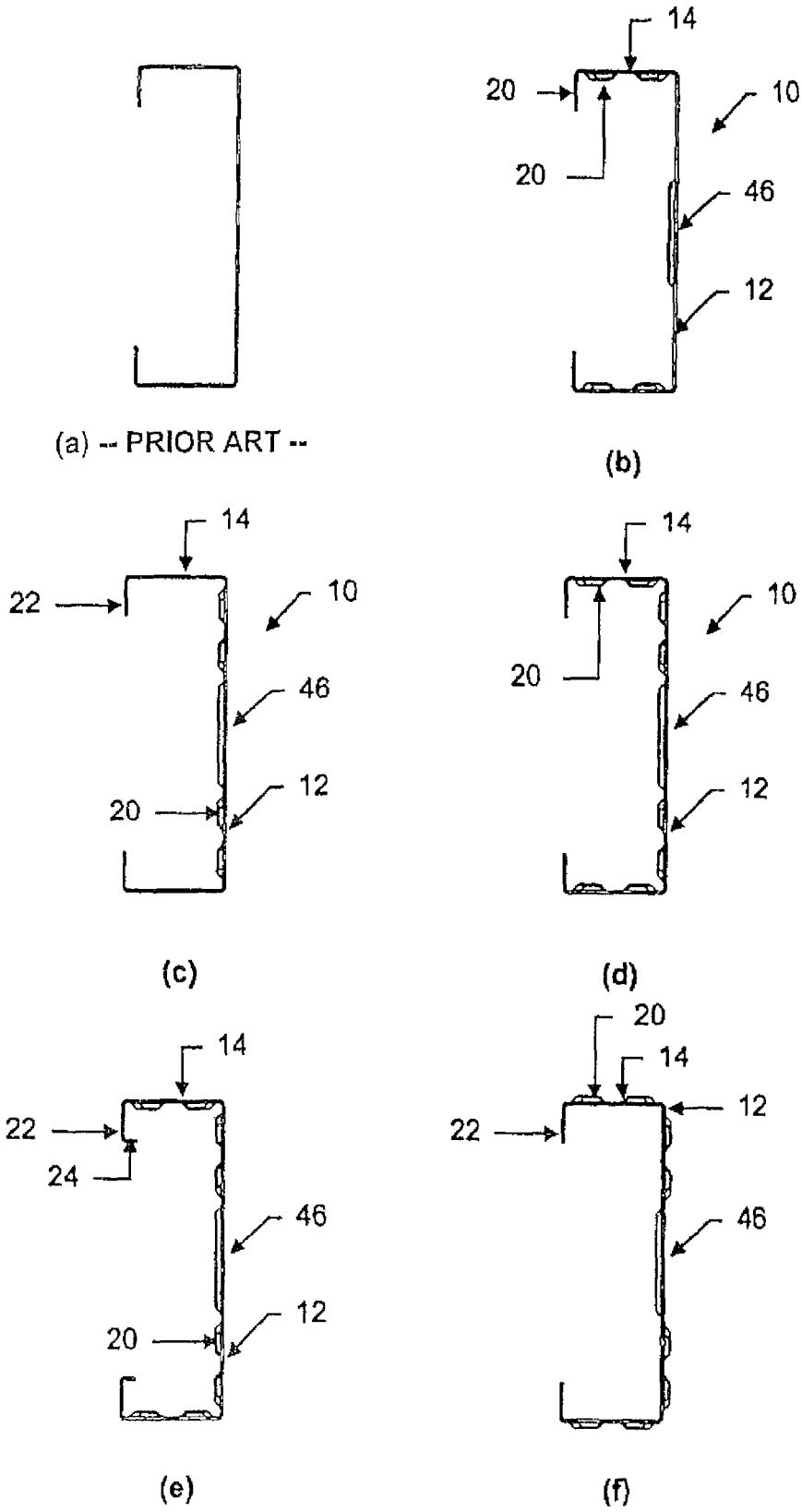
FIG. 5 (*a*) is a cross sectional view of a prior art member and FIG. 5 (*b*) to (*f*) are cross sectional view of five alternate embodiments of the light steel structural member of the present embodiment showing alternate embossment positioning, configuration and reinforced utility holes.

Embosses 20 can have a variety of different shapes and arrangements as shown in FIG. 4. FIG. 4 (*a*) shows embosses that are generally elongate narrow ribs 26. FIG. 4 (*b*) shows embosses that are generally wide elongate ribs 28. FIGS. 4 (*c*) and (*d*) show generally trapezoidal shaped embosses 30. In FIG. 4 (*c*) the embosses 30 are generally aligned while in FIG. 4 (*d*) the embosses are generally off set. It will be appreciated by those skilled in the art that a wide variety of shapes may be used for the embosses. Specifically, a number of different polygonal shapes could also be used. Different portions of the member 10 could have the embosses 20 formed therein as shown in the different embodiments shown in FIG. 5. These differences are contrasted to the prior art C-section shown in FIG. 5 (*a*) which has no embosses. As shown herein the embosses may extend outwardly or inwardly. The embodiment of the light steel structural member 10 shown in FIG. 5 (*b*) has inward embosses 20 on the flange portions 14 and a utility hole 46 formed in the web portion 12. The embodiment of the light steel structural member 10 shown in FIG. 5 (*c*) has inward embosses 20 on the web portion 12 and a utility hole 46 formed in the web portion 12. The embodiment of the light steel structural member 10 shown in FIG. 5 (*d*) has inward embosses 20 on the flange portions 14 and inward embosses 20 and a utility hole 46 formed in the web portion 12. The embodiment of the light steel structural member 10 shown in FIG. 5 (*e*) has inward embosses 20 on the flange portions 14; inward embosses 20 and a hole 46 formed in the web portion 12; and a stiffener 24 extending inwardly from the lip 22. The embodiment of the light steel structural member 10 shown in FIG. 5 (*f*) has outward embosses 20 on the flange portions 14 and outward embosses and an over punched utility hole 46 formed in the web portion 12.

Figure 6:
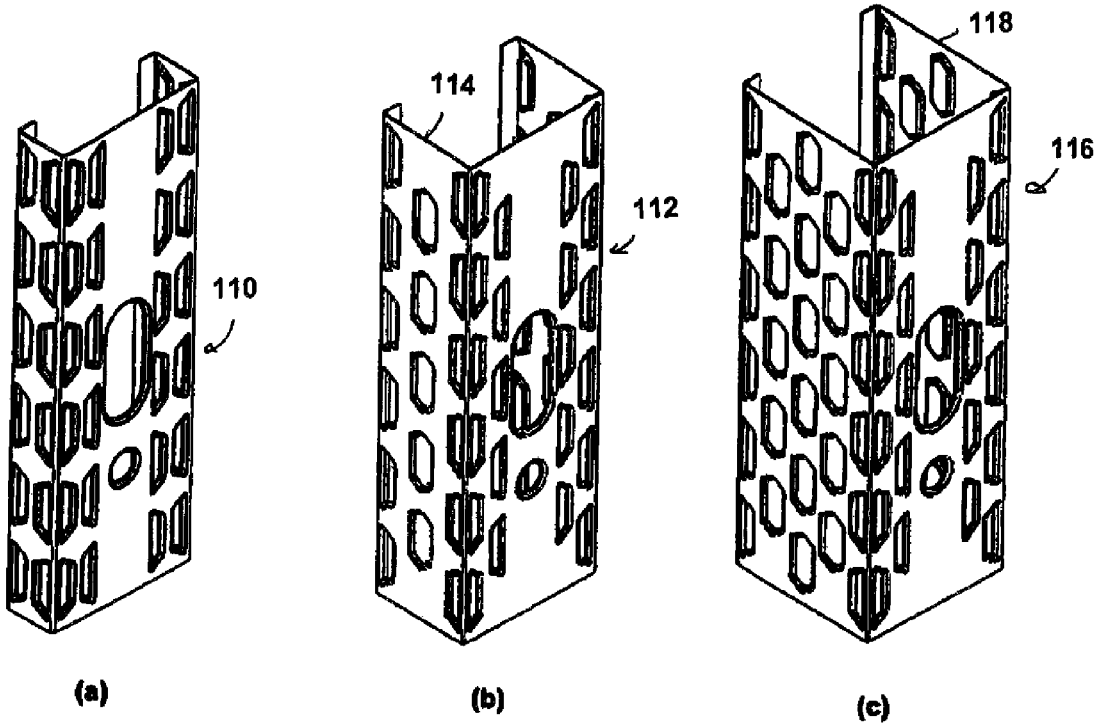
FIG. 6 (*a*) to (*c*) are perspective views of three alternate embodiments of the light steel structural member of the present embodiment showing alternate relative sizes of the web and the flange.
Figure 7:
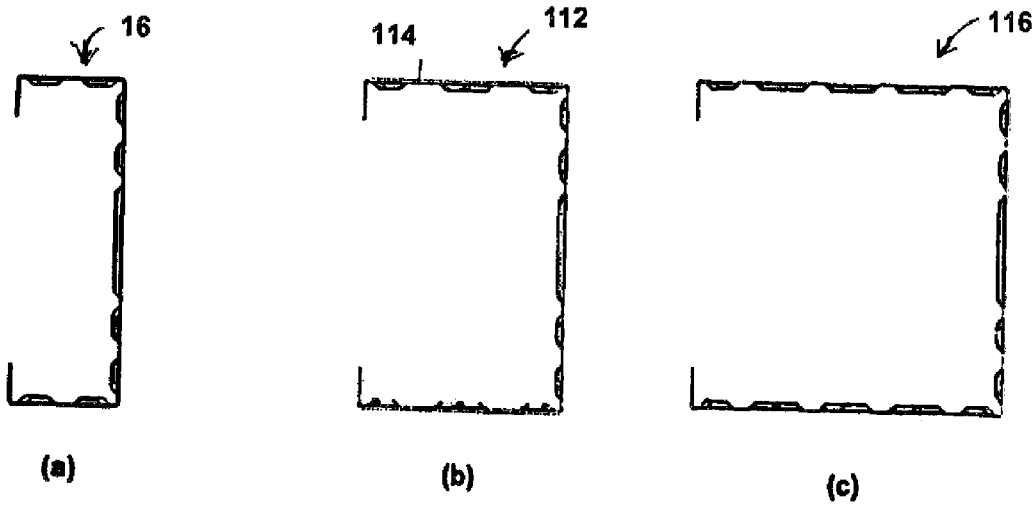
FIG. 7 (*a*) to (*c*) are cross sectional views of the three alternate embodiments of the light steel structural members shown in FIG. 6.

As shown in FIGS. 6 and 7 the width of the flanges relative to the width of the web may vary depending on the particular application where the member will be used. With prior art C-shaped members it is a common practice to gange together two or three C-sections. The embodiments shown in FIGS. 6 and 7 provide a variety of different dimensions so that one section of a predetermined shape may be used for a specific application. The light steel structural member 110 shown in FIGS. 6 (*a*) and 7 (*a*) shows the conventional size of C-section. The light structural steel member 112 shown in FIGS. 6 (*b*) and 7 (*b*) is a shape comparable to two C-sections ganged together, wherein the flange portion 114 is lengthened. The light steel structural member 116 shown in FIGS. 6 (*c*) and 7 (*c*) is a shape comparable to three C-shaped members ganged together and wherein the flange portion 118 is further lengthened.

Figure 8:
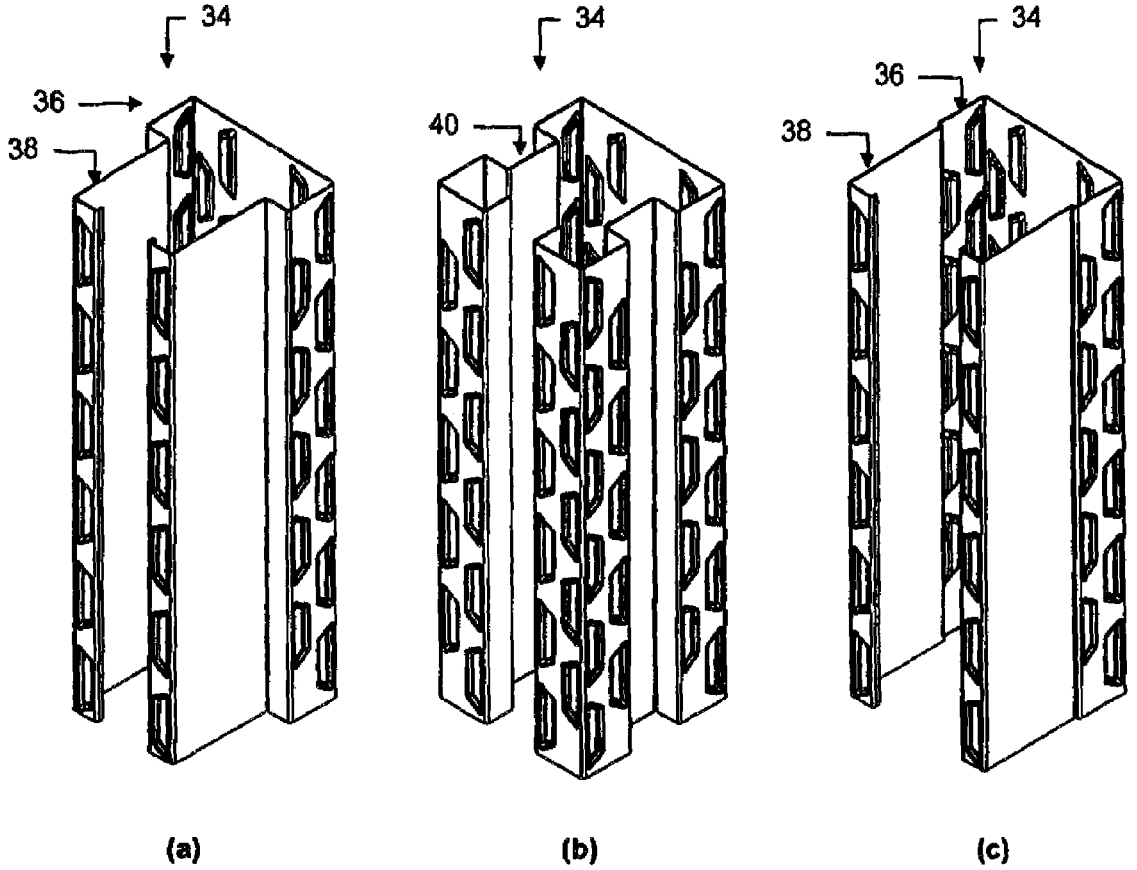
FIG. 8 (*a*) to (*c*) are perspective views of three alternate embodiments of the light steel structural studs of the present embodiment showing alternate flange configurations.
Figure 9:
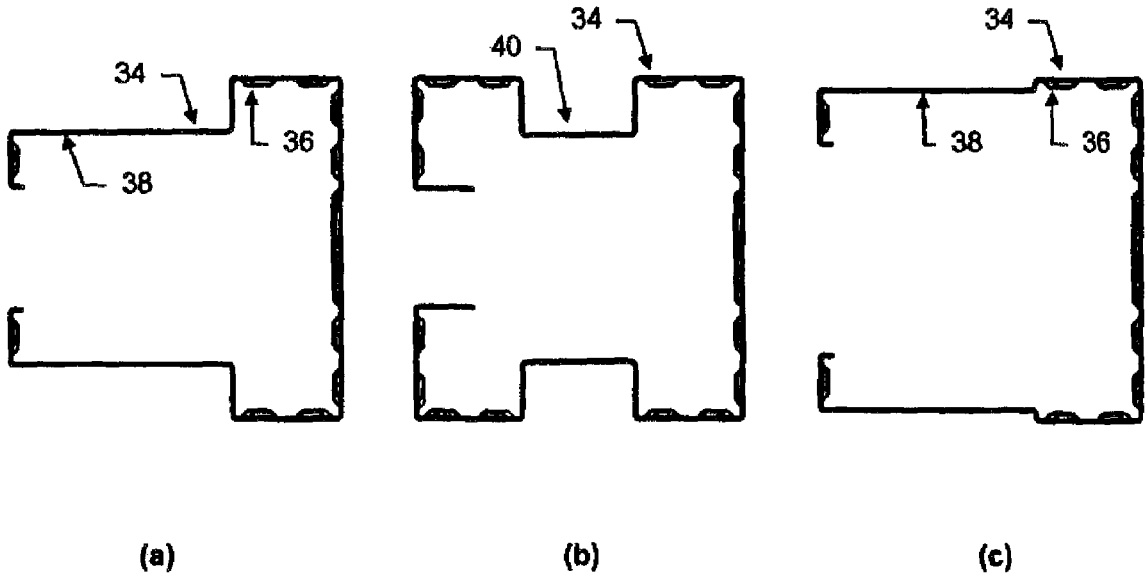
FIG. 9 (*a*) to (*c*) are cross sectional views of the three alternate embodiments of the light steel structural studs shown in FIG. 8.
Figure 21:
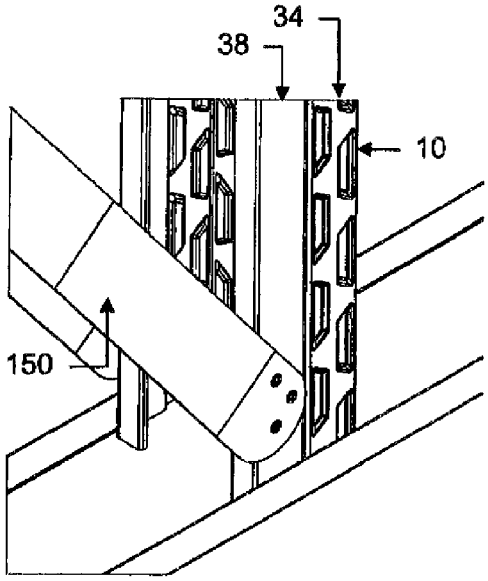
FIG. 21 is an enlarged perspective view of a connection with a bracing member used with an embodiment of the light steel structural member having a small indent in the flange.
Figure 22:
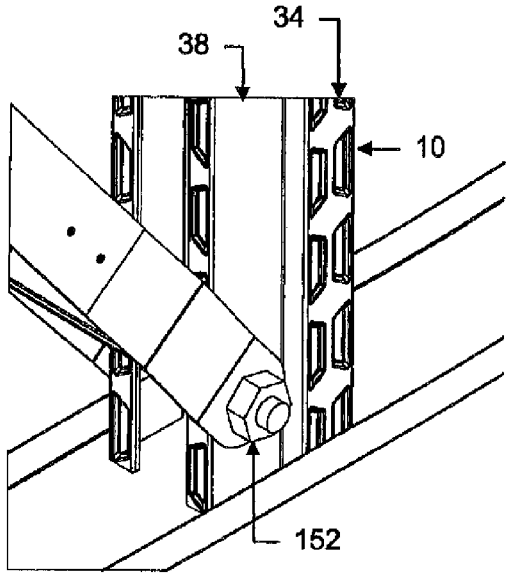
FIG. 22 is an enlarged perspective view of a connection with heavy modular structural bracing used with an embodiment of the light steel structural member having a large indent in the flange.

Referring to FIGS. 8 and 9 various indents may be used depending on the application of the member. Flange 34 may include a web end portion 36 and an indent portion 38. The indent portion 38 is spaced inwardly from the web end portion 36. FIGS. 8 (*a*) and 9 (*a*) show a large indent and FIGS. 8 (*c*) and 9 (*c*) show a small indent. These indents are particularly useful for attaching the member to bracing as shown in FIGS. 21 and 22. As shown in FIGS. 8 (*b*) and 9 (*b*), the light steel structural member may also have a generally rectangular groove 40 formed in flange 34. The indent portion 38 and the rectangular groove 40 may be used to facilitate connections and to facilitate interfaces with other material elements.

Figure 10:
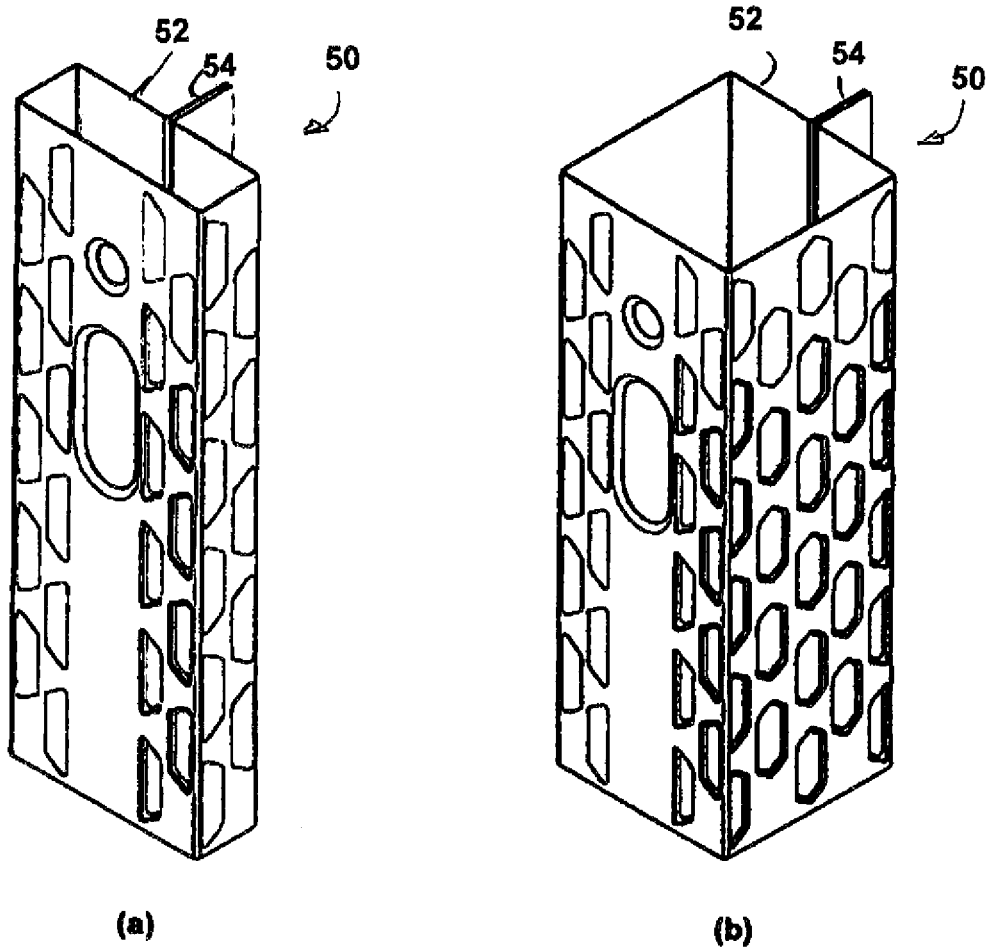
FIGS. 10 (*a*) and (*b*) are perspective views of two alternate embodiments of the light steel structural member of the present embodiment wherein the members are closed members.
Figure 11:
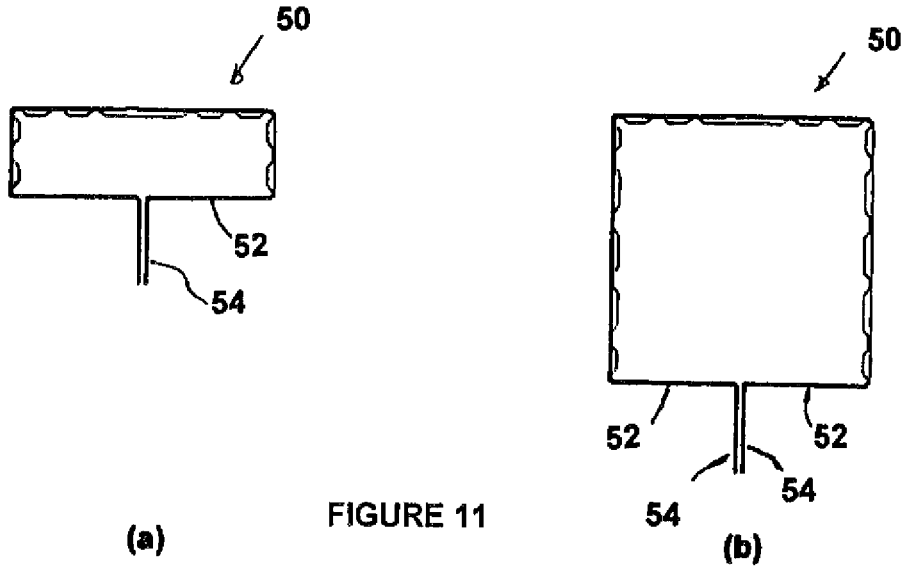
FIGS. 11(*a*) and (*b*) are cross sectional view of the two closed member embodiments shown in FIG. 10.
Figure 12:
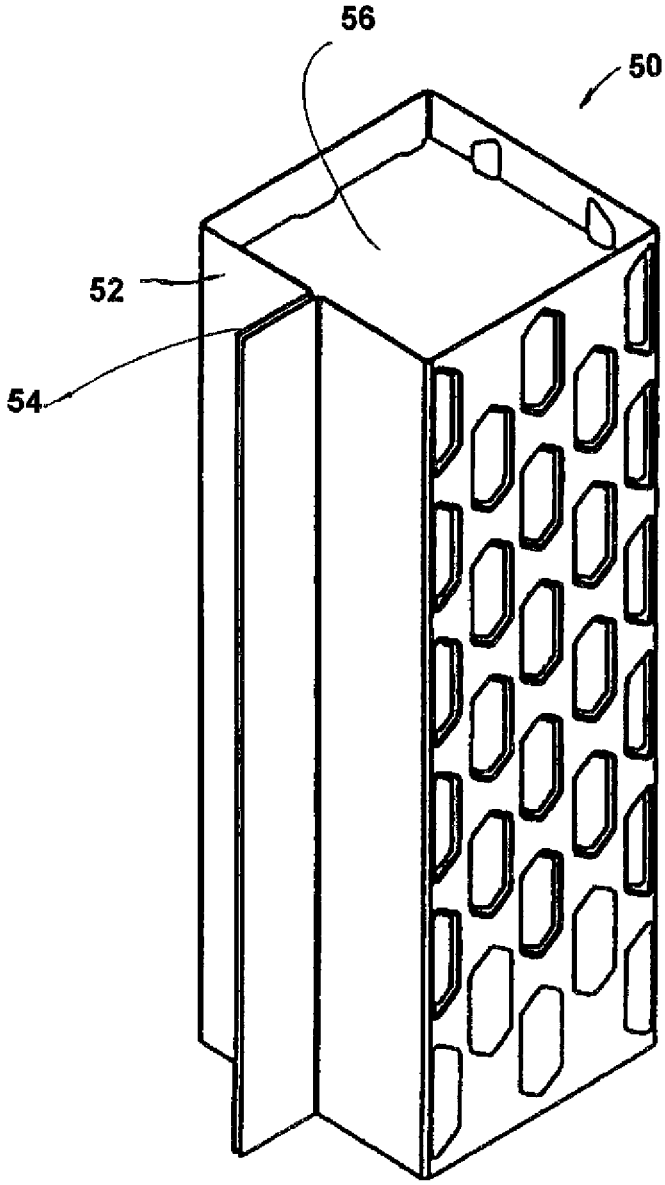
FIG. 12 is a perspective view of a closed member embodiment as a composite column.

An alternate embodiment is shown in FIGS. 10, 11 and 12 wherein the light steel structural member 50 each show an extended lip 52 which meets the opposed extended lip to provide a closed member. The extended lips 52 each have a stiffener 54 which may be joined. The closed member 50 may also be filled with concrete 56 to form a composite member as shown in FIG. 12.

Figure 13:
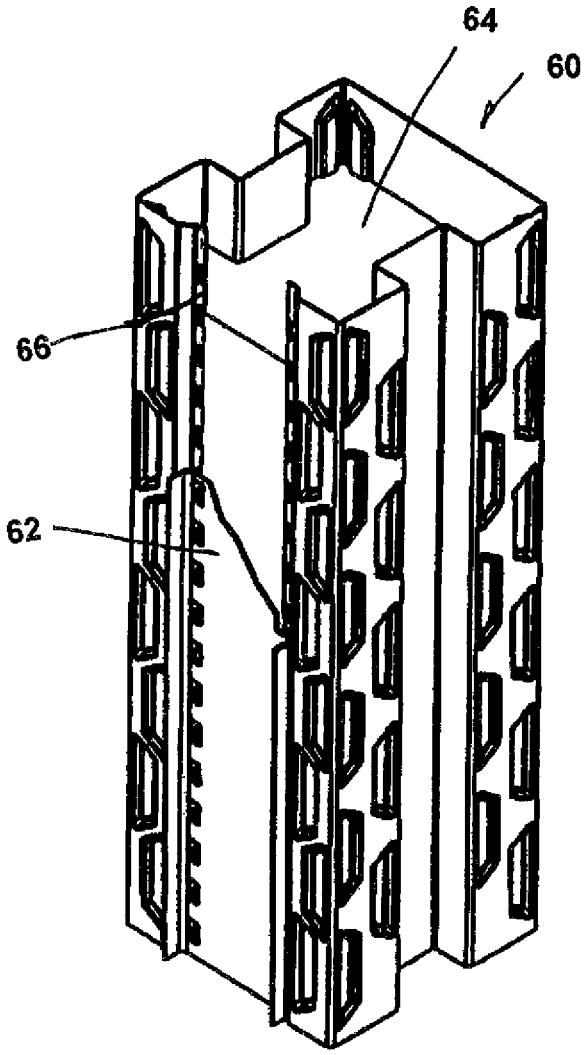
FIG. 13 is a perspective view of a composite column used with a light steel structural member similar to those shown in FIGS. 8(*b*) and 9 (*b*)
Figure 14:
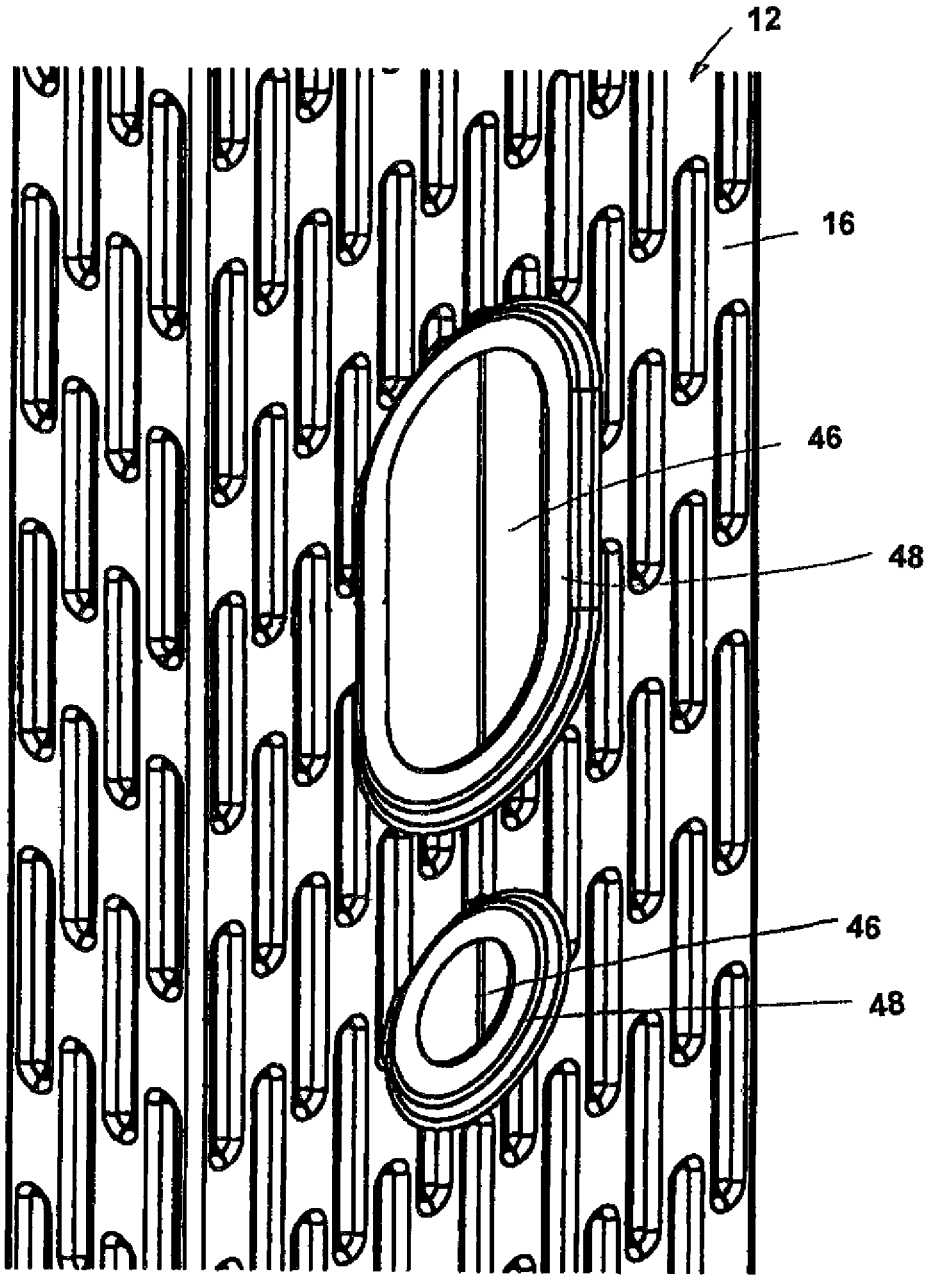
FIG. 14 is a perspective view of a bridging and utility hole used with the light steel structural member of the present embodiment.
Figure 16:
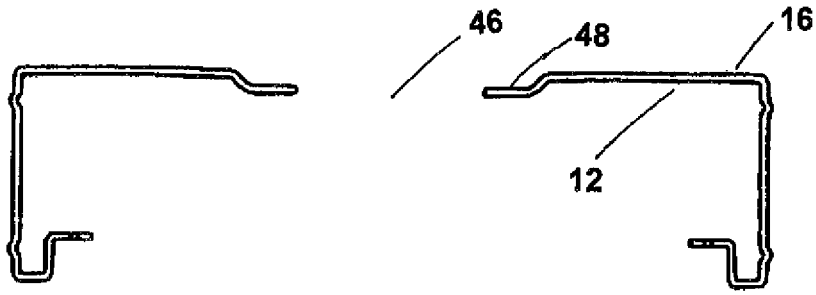
FIG. 16 is a cross sectional view of FIG. 15 taken through the bridging and utility hole.
Figure 15:
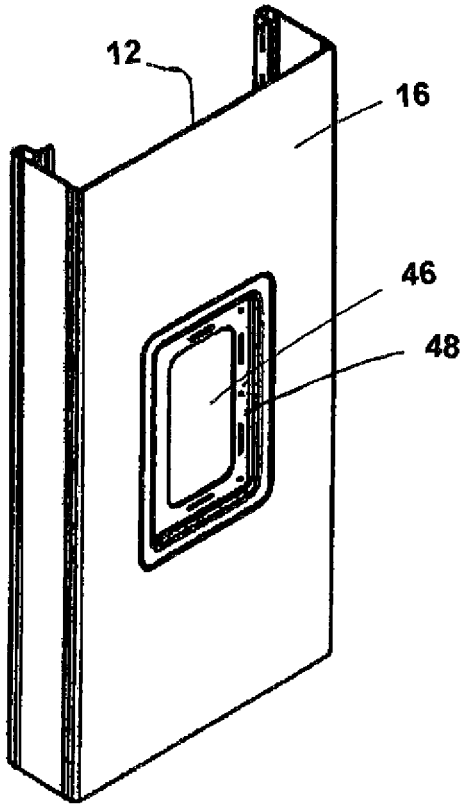
FIG. 15 is a perspective view of an alternate bridging and utility hole used with the light steel structural member.

Alternate forms of composite members are shown in FIG. 13 wherein the embodiment of the light steel structural member shown in FIGS. 8 (*b*) and 9 (*b*) is filled with concrete 64. Light steel structural member 60 has a plate 62 attached to the multi-cranked stiffeners 66.

Figure 17:
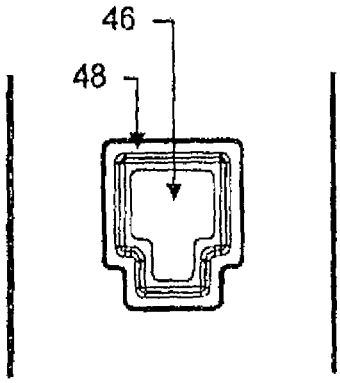
FIG. 17 (*a*) to (*d*) are front views of four alternate embodiments of bridging and utility holes used with the light steel structural member.
Figure 17:
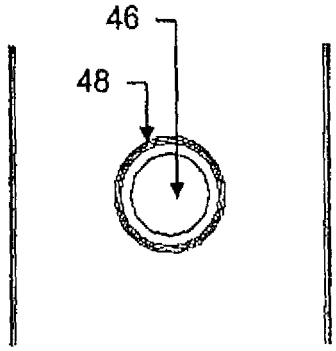
Figure 17:
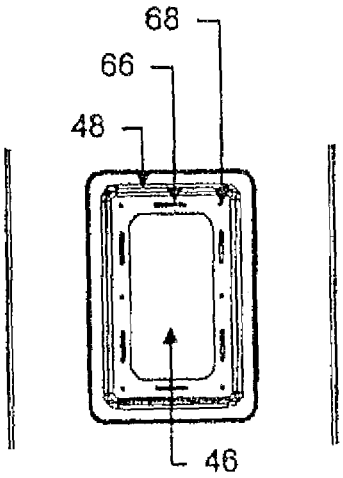
Figure 17:
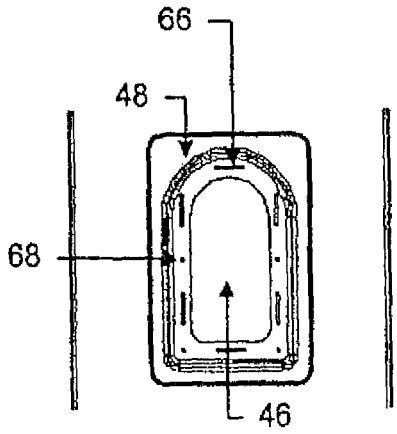

Referring to FIGS. 14 to 19, preferably the light steel structural members include a hole 46 with hole reinforcement 48. The hole is formed in the web portion 12 of the member and the hole reinforcement 48 extends inwardly from the face 16 of the web portion 12. Since the reinforcement 48 is inward of the face 16 it allows for the use of many existing bridging details. It will be appreciated by those skilled in the art that the hole 46 may have a variety of different shapes. Examples of some shapes are shown in FIG. 17 (*a*) through (*d*). The hole 46 has a squared key hole shape in FIG. 17 (*a*), a round shape in FIG. 17 (*b*), a rectangular shape in FIG. 17 (*c*), and a generally rectangular shape with a top arch in FIG. 17 (*d*). In the embodiments shown in figures (*c*) and (*d*), slits 70 and screw holes 68 are provided in hole reinforcement 48 so that items may be attached thereto. The user may pick an appropriate shape for the particular application.

Figure 18:
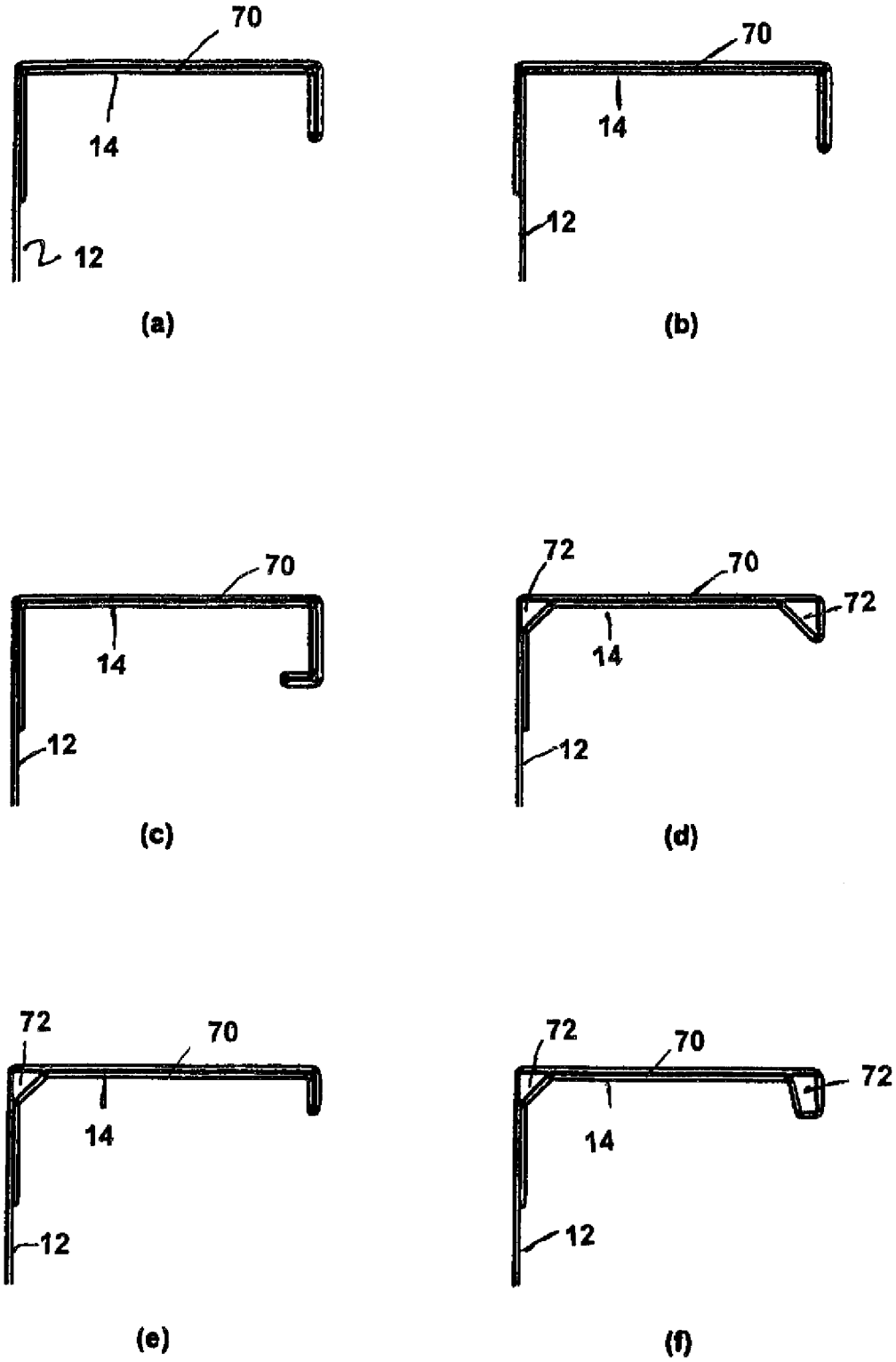
FIG. 18 (*a*) to (*f*) are cross sectional views of six alternate embodiments of the flange portion of the light steel structural member showing double flange alternatives.
Figure 19:
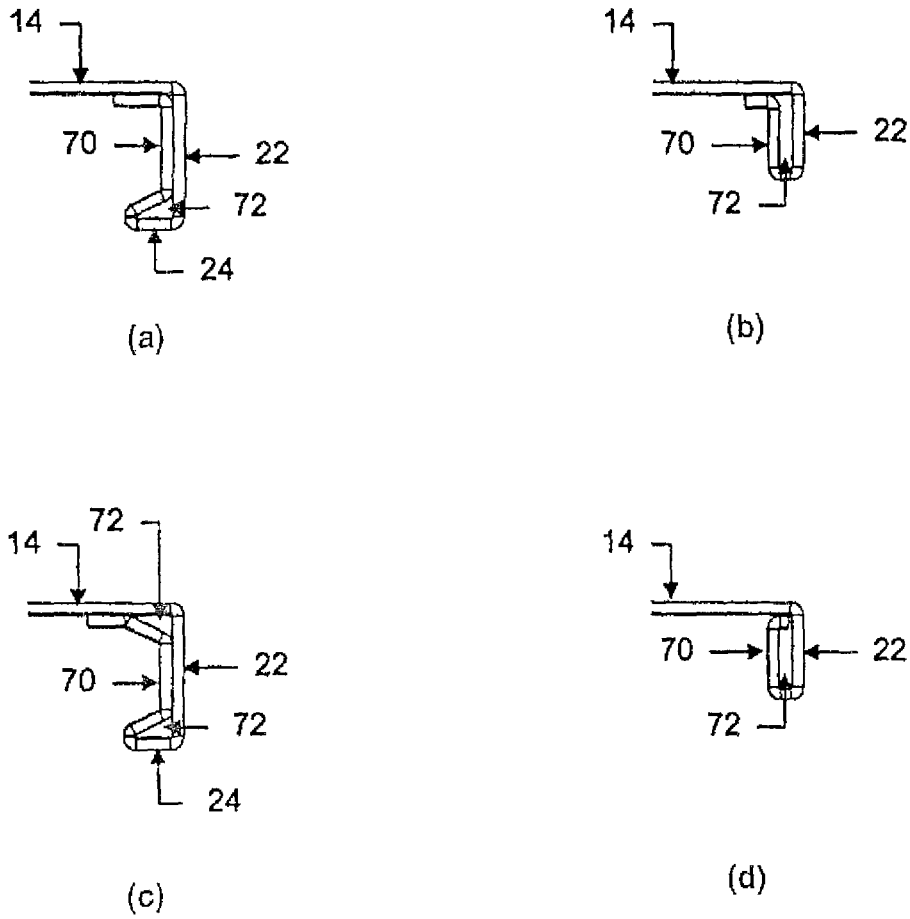
FIG. 19 (*a*) to (*d*) are cross sectional views of four further alternate embodiments of the flange portion of the light steel structural member showing an open double flange alternatives.

Referring to FIGS. 18 and 19, the light steel structural member may be shaped such that a portion of the member has a double thickness portion 70. As shown in FIGS. 18 and 19 the double thickness portion may be on the inside as shown in FIG. 18 (*a*) or on the outside as shown in FIG. 18 (*b*). The double thickness embodiment may be used with member having a flange, a lip and a lip stiffener. The double thickness may be arranged such that it provides hollow portions 72 as shown in FIG. 18 (*d*) (*e*) and (*f*). Alternatively the double thickness portion may be primarily a double thickness of the lip 22 and stiffener 24 as shown in the four embodiments of FIG. 19.

Figure 20:
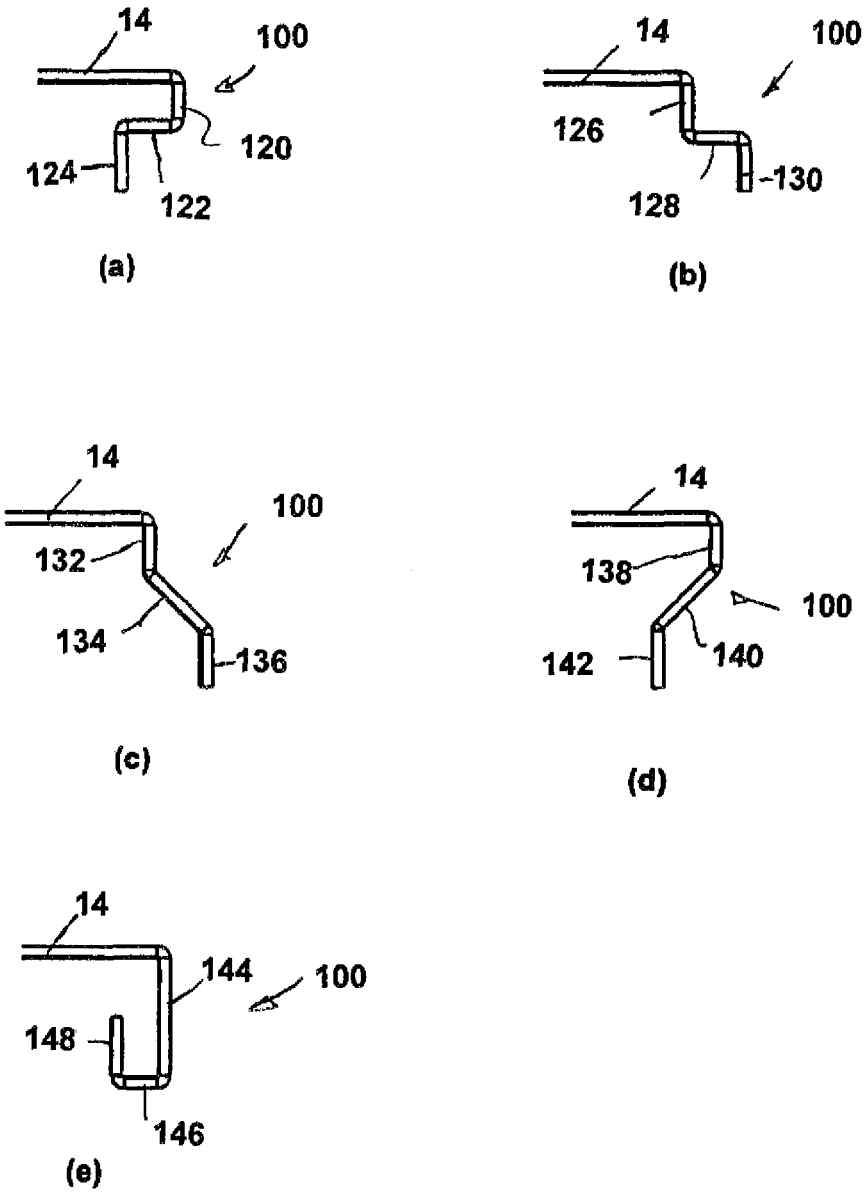
FIG. 20 (*a*) to (*e*) are cross sectional views of five alternate embodiments of the flange potion of the light steel structural member showing alternate lip configurations.

As shown in FIG. 20, the configuration of the lip and lip stiffener of the light steel structural member may vary. Specifically the light steel structural member may include various configurations of multi-cranked stiffeners 100. Embodiment shown in FIG. 20 (*a*) shows a multi-cranked stiffener 100 having a first portion 120 generally orthogonal to the flange 14, a second portion 122 extending inwardly and generally orthogonal to the to the first portion and a third portion 124 orthogonal to the second portion and extending away from the flange 14. Embodiment of FIG. 20 (*b*) shows a multi-cranked stiffener 100 having a first portion 126 generally orthogonal to the flange 14, a second portion 128 extending outwardly and generally orthogonal to the first portion and a third portion 130 orthogonal to the second portion and extending away from the flange 14. Embodiment of FIG. 20 (*c*) shows a multi-cranked stiffener 100 having a first portion 132 generally orthogonal to the flange 14, a second portion 134 extending outwardly and angled from the first portion and a third portion 136 in a plane generally parallel to the plane of the first portion and extending away from the flange 14. Embodiment of FIG. 20 (*d*) shows a multi-cranked stiffener 100 having a first portion 138 generally orthogonal to the flange 14, a second portion 140 extending inwardly and angled from the first portion and a third portion 142 in a plane generally parallel to the plane of the first portion and extending away from the flange 14. Embodiment (*e*) shows a multi-cranked stiffener 100 having a first portion 144 generally orthogonal to the flange 14, a second portion 146 extending inwardly and generally orthogonal to the to the first portion and a third portion 148 orthogonal to the second portion and extending towards the flange 14.

Referring to FIGS. 21 and 22 a bracing member 150 may be used with the light steel structural member. It may be used with a light bracing member shown in FIG. 21 or a heavy bracing member shown in FIG. 22. The appropriate indent should be chosen to match the member attached thereto.

Figure 23:
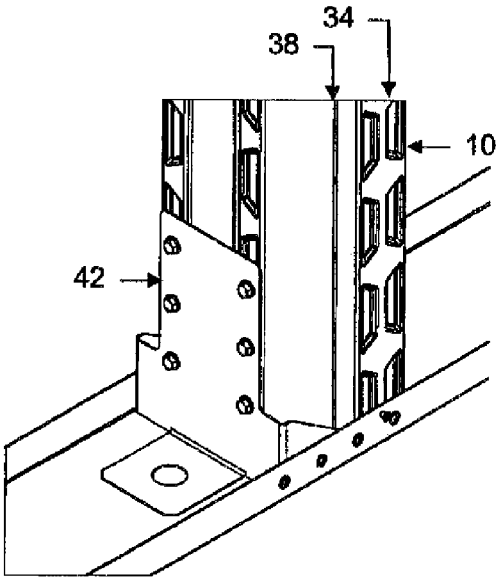
FIG. 23 is an enlarged perspective view of a connection bracket for use with the light steel structural member having an indent in the flange.

FIG. 23 shows a connection bracket 42 that may be used with the light steel structural member 10 having an indent 38 in the flange 34. Preferably the connection bracket 42 tracks the indent 38. The connection bracket 42 is for use to attach the member 10 to the floor below.

Figure 24:
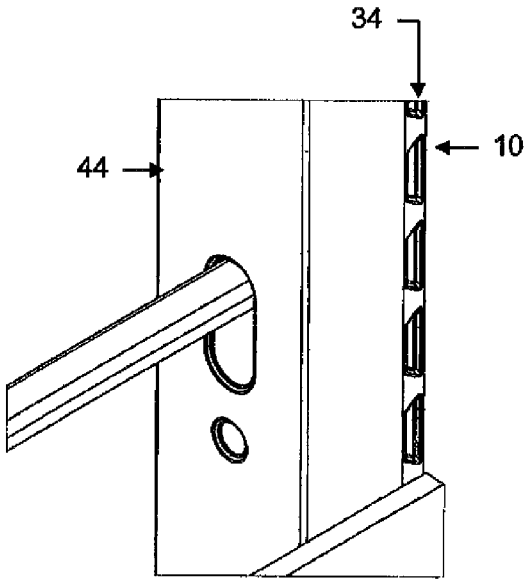
FIG. 24 is an enlarged perspective view of the cap for use in conjunction with the light steel structural member of the present embodiment.
Figure 25:
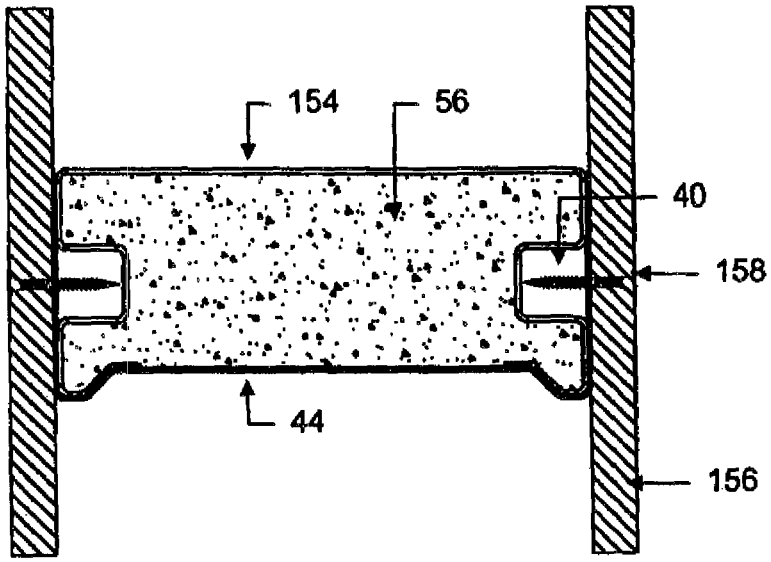
FIG. 25 is a cross sectional view of a composite stud baton of the light steel structural member.
Figure 26:
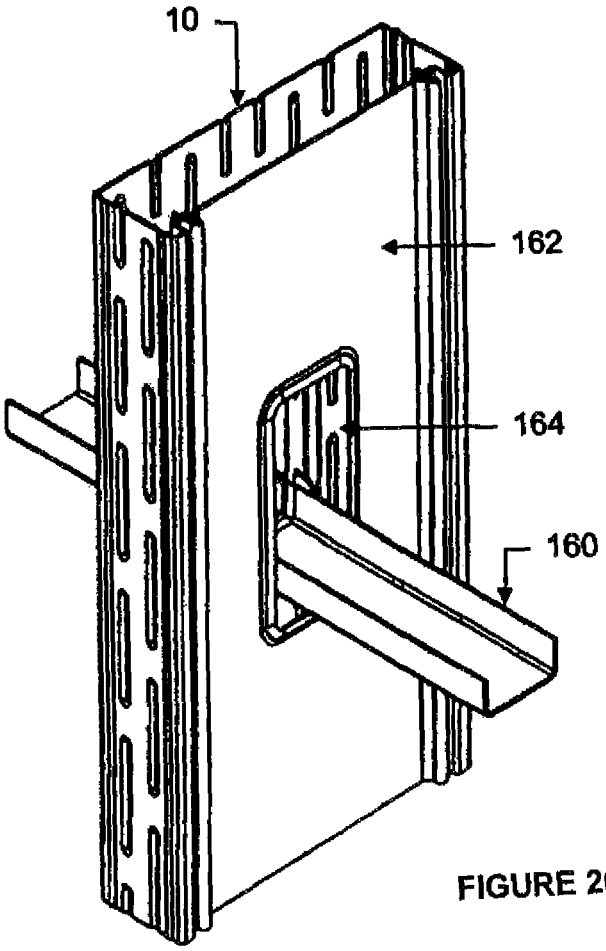
FIG. 26 is a perspective view of a light steel structural member with a bridging and access hole showing a bridging member positioned therein.

Referring to FIG. 24 a cap may be used in conjunction with the light steel structural member 10. The cap 44 is particularly useful as shown in FIGS. 13 and 25 for use with composite members. The use of a composite member is shown in FIG. 25. The shape of the light steel structural member 154 is similar to that shown in FIGS. 8 (*b*) and 9 (*b*) with a stiffener similar to that shown in FIG. 20 (*d*). A cap 44 is attached to the structural member 154. The structural member 154 is filled with concrete 56. Wall covering 156 is attached to the structural member 154 with a screw 158. The screw 158 pierces cap 44 and groove 40 is provided for the end of the screw 158.

Figure 27:
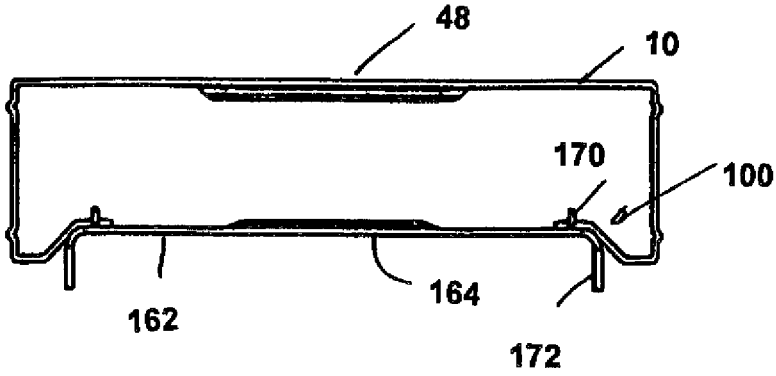
FIG. 27 is a cross sectional view of a light steel structural member used as a standard baton.
Figure 28:
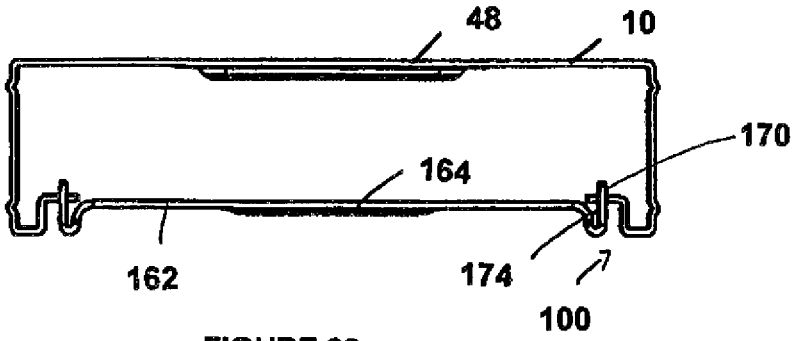
FIG. 28 is a cross sectional view of a light steel structural member used as a standard baton with double stiffener.
Figure 29:
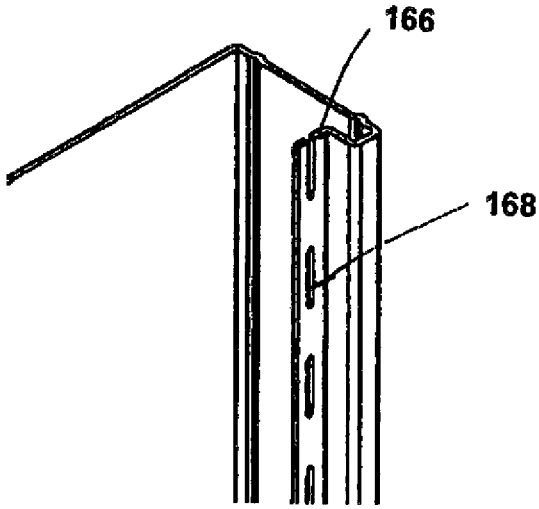
FIG. 29 is perspective view of the flange portion of a light steel structural member showing the lip arranged for use with a baton or utilities.
Figure 30:
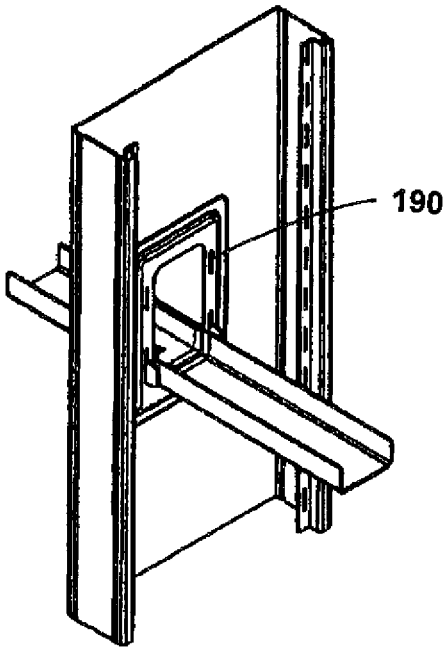
FIG. 30 is a perspective view of a light steel structural member having a bridging member attached thereto.

Referring to FIGS. 26 to 34, the light steel structural members 10 may be adapted to provide a snap-in-place bridging system. The snap-in-place bridging system includes a bridging member 160 and a baton 162. The baton 162 is placed on the open side of the C-Shape metal member 10 which effectively creates a closed section thereby increasing the capacity of the member for axial loaded conditions. The batons 162 may be placed intermittently and thereby significantly improving the section capacity. A full length baton 162 may also be used to close the member 10 so that the member 10 can easily be filled with concrete. The baton 162 includes a hole 164 that corresponds to the hole reinforcement 48 described above. The light steel structural member 10 is provided with a multi-crank lip 100. The multi-crank lip 100 has an engagement portion 166 for engaging the baton 162. The engagement portion 166 has a plurality of holes 168 formed therein for receiving baton fingers 170, best seen in FIGS. 27 and 29. The baton 162 may have a standard engagement portion 172 as shown in FIG. 27 or it may have a double stiffener engagement portion 174 as shown in FIG. 28.

Figure 32:
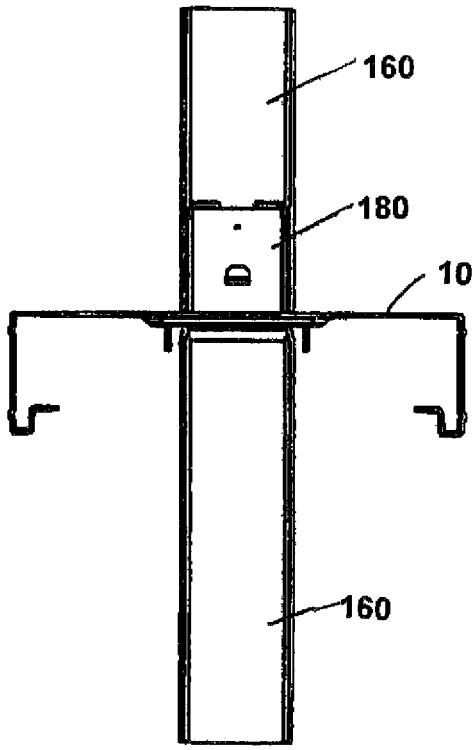
FIG. 32 is a cross sectional view of FIG. 30 showing the connection between the light steel structural member and the bridging member.
Figure 31:
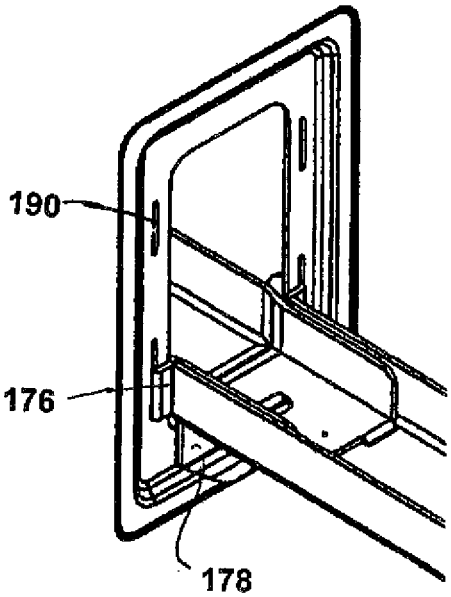
FIG. 31 is an enlarged perspective view of FIG. 30 showing the connection between the light steel structural member and the bridging member.
Figure 33:
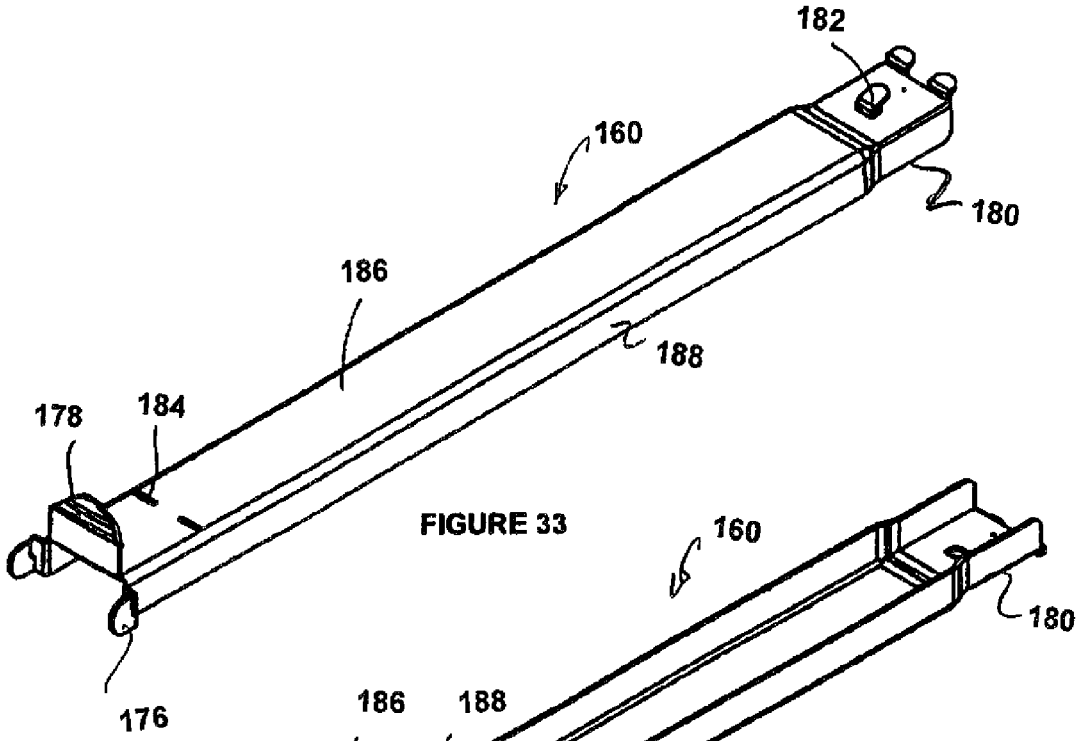
FIG. 33 is a perspective top view of the bridging member.
Figure 34:
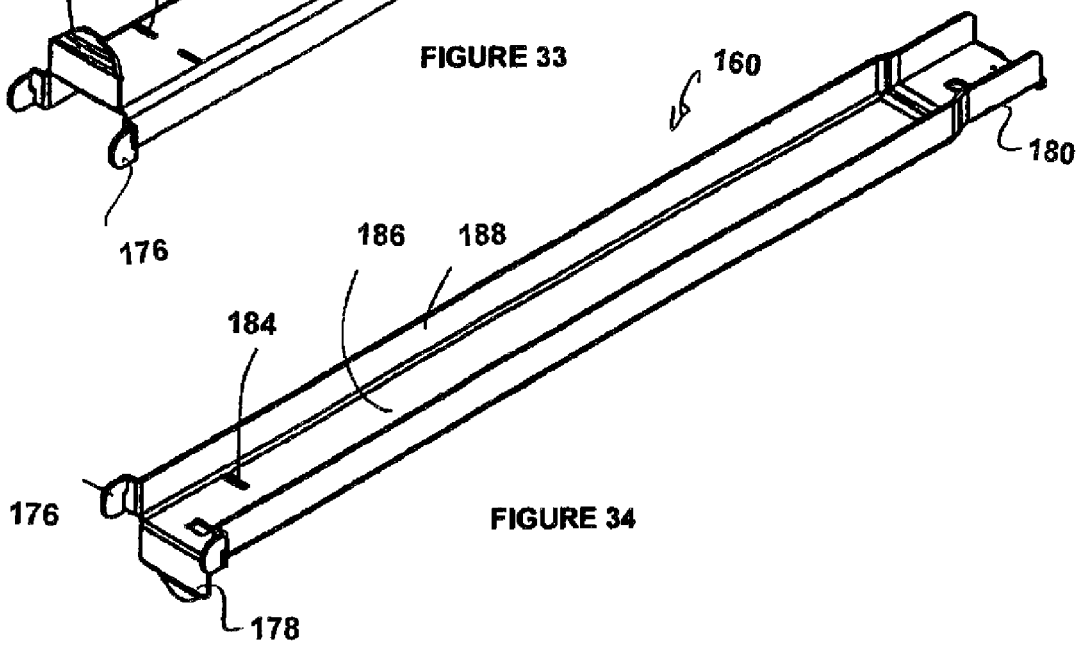
FIG. 34 is a perspective bottom view of the bridging member.

Bridging member 160 has stud engagement fingers 176 and a stabilizing tongue 178 at one end thereof and a bridge engagement portion 180 at the other end thereof. As shown in FIGS. 31 and 32, bridge engagement portion 180 includes bridge engagement fingers 182 adapted to engage bridge engagement holes 184 in the adjacent bridging member 160 and bridge engagement portion 180 nests inside the adjacent bridging member 160. Bridging member 160 includes a web portion 186 and a flange portion 188. Bridging holes 190 are provided in at least one of the hole reinforcement 48 or hole 164.

Further beneficial features are found in the snap-in-place bridging system wherein the parts have been developed to snap in place without a great deal of time, in which case the bridging also helps resist torsion in the member. The snap-in place bridging provides the tradesman a means to set the distance between members without the need of a tape measure.

Figure 35:
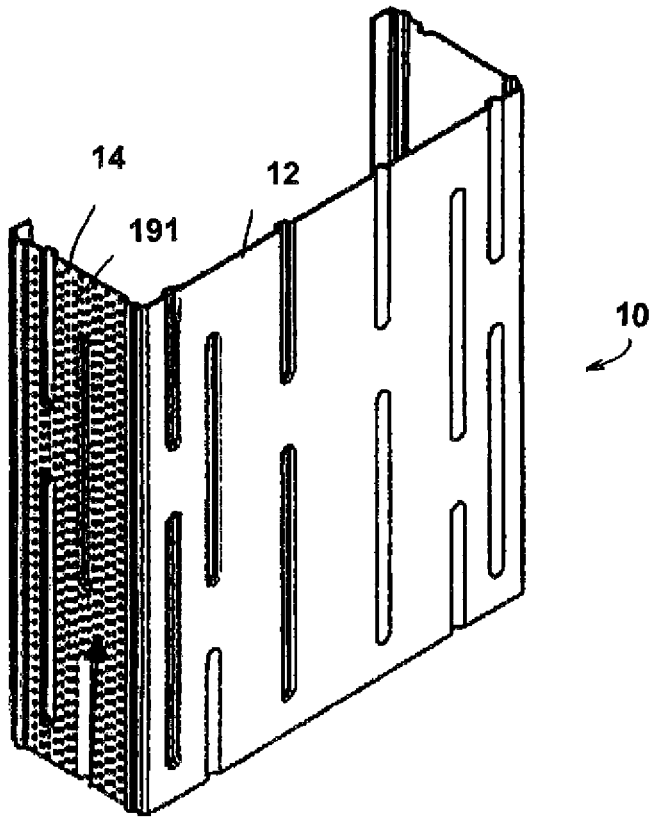
FIG. 35 is a perspective view of an embodiment of a light steel structural member showing a flange portion with an etched and knurled surface.
Figure 36:
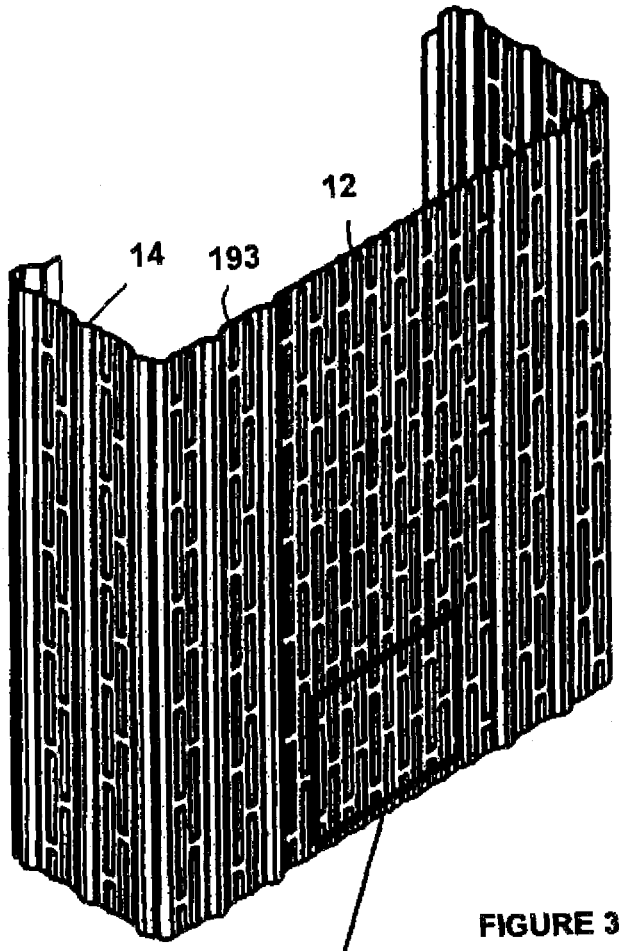
FIG. 36 is a perspective view of an embodiment of a light steel structural member showing an etched and knurled surface over the whole surface.
Figure 37:
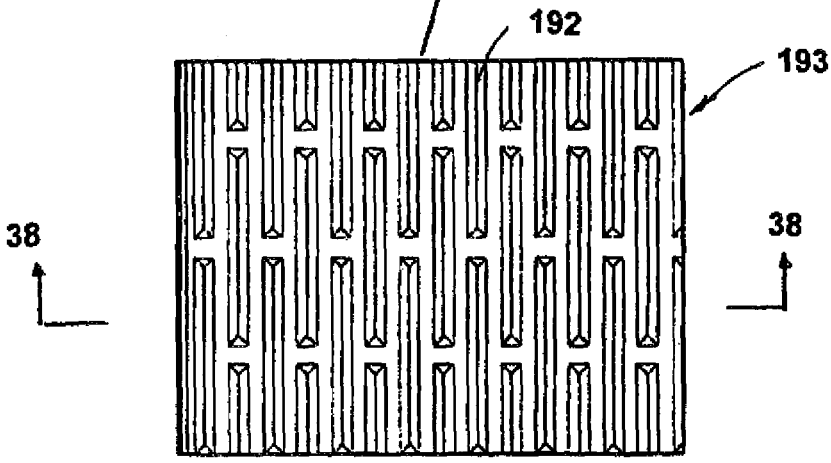
FIG. 37 is an enlarged front view of the surface treatment of the embodiment shown in FIG. 36.
Figure 38:
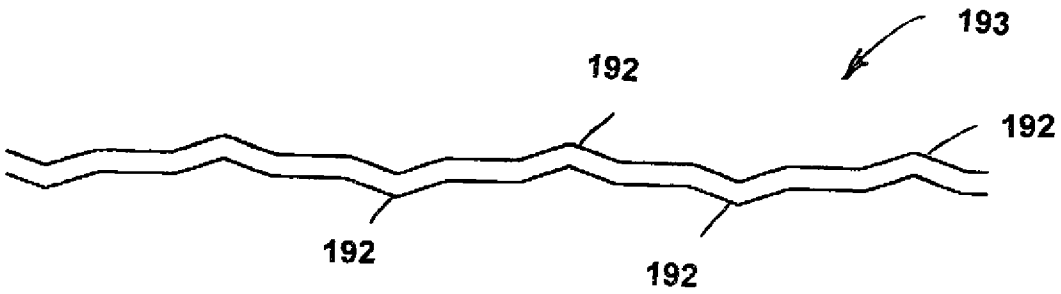
FIG. 38 is an enlarged cross sectional view of the surface treatment shown in FIG. 37.

Referring to FIGS. 35 to 38 all or a portion of the light steel structural member 10 may have etching or knurling 191 on all or just some of the surface. As shown in FIG. 35 the etching or knurling 191 is on the flange portion 14. The knurling 191 is in addition to the embosses 20. As shown in FIG. 36, alternatively the surface treatment may be light embosses 193 and they can be over the whole surface of the light steel structural member 10. An enlarged view of the light embosses is shown in FIGS. 37 and 38 wherein the light embosses include a plurality of spaced apart elongate detents 192. Preferably the detents extend both inwardly and outwardly as seen in FIG. 38. Preferably the elongate detents are generally arranged axially and the detents are spaced axially and horizontally over the surface of the member 10. It will be appreciated by those skilled in the art that the surface treatment may be provided over the whole or a portion of the member 10. The surface treatment may be embosses 20, knurling or etching 191, light embosses 193 or a combination thereof. Typically the depth of the knurling or etching 191 is between 0.5 to 1.5 t where t is the thickness of the sheet material; the depth of the light embosses is between 1 and 2.5 t; the depth of the embosses 20 is between 2 and 6 t; and the depth of the continuous ribs 304 (described in more detail below) is between 2 and 4 t.

Figure 39:
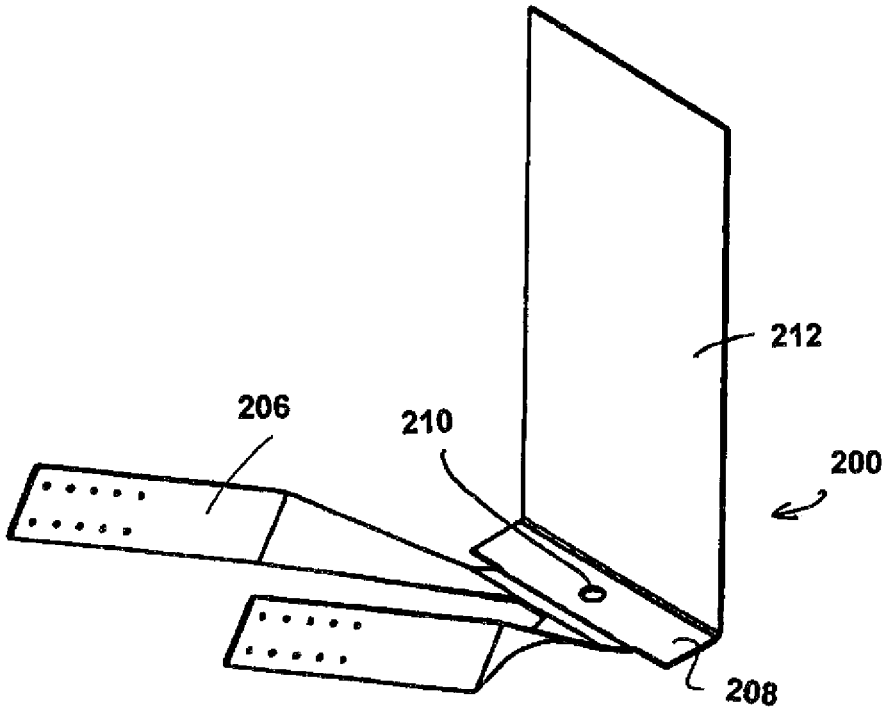
FIG. 39 is a perspective view of a concentric strap bracing connector for the light steel structural member.
Figure 40:
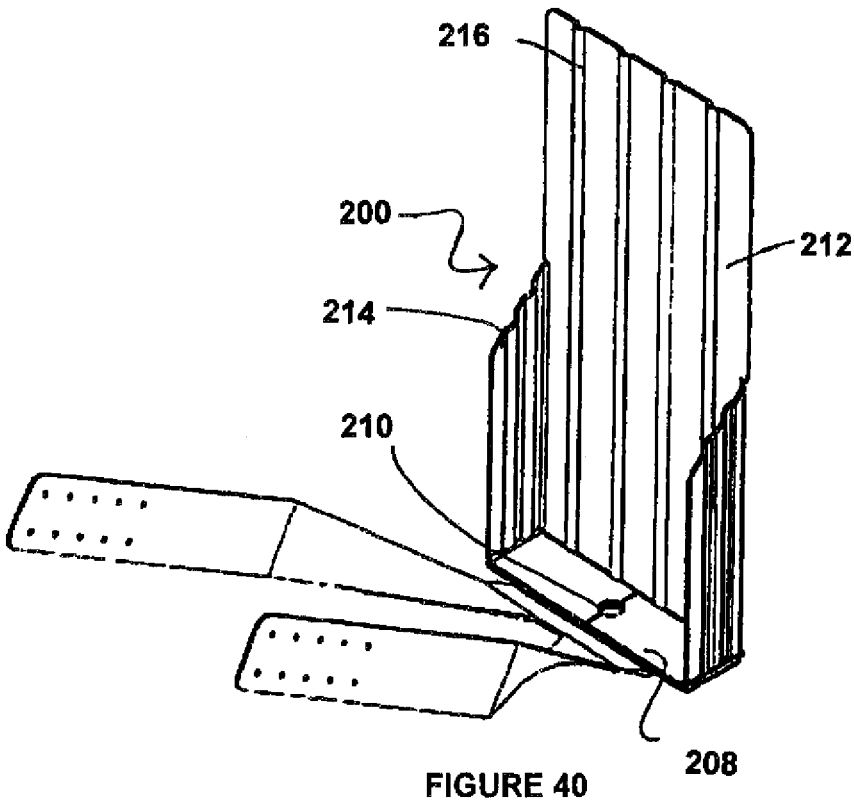
FIG. 40 is a perspective view of a concentric strap bracing connector with side stiffeners for the light steel structural member.

It will be appreciated by those skilled in the art that aligning the surface treatment embossments along the longitudinal axis of the structural member provides increased sheet material stiffening versus current surface treatment techniques such as UltraSTEEL (U.S. Pat. Nos. 6,183,879 & 5,689,990) surface treatment. The light gauge material generally experiences local buckling from compressive stresses applied along the longitudinal axis of flexural and axially loaded members. Therefore, sheet bending as a result of buckling occurs about an axis perpendicular to the longitudinal axis. By aligning the segmented line embossments with the longitudinal axis, the sub-elements being bent have a constant depth equal to the depth of the embossment, which maximizes the stiffening of the sheet material Referring to FIGS. 39 to 41 strap bracing anchors 200 may be attached to light steel structural members 10. Bracing anchors 200 include an anchor bolt 202 (shown in FIG. 41 (*b*) which transfers the loads directly to the anchor bolts that are placed in the concrete. Bracing anchor member 200 includes strap engagement portions 206 and floor engagement portion 208. Floor engagement portion 208 has a hole 210 formed therein for receiving an anchor bolt 202. A stud portion 212 extends orthogonally from the floor engagement portion 208 and is adapted to rest against the structural member 10. Bracing anchor member 200 may also include side stiffeners 214. As well the stud portion 212 and side stiffeners 214 may also include ribs 216 to help stiffen the anchor 200. Bracing anchors 200 are connected to strap bracing 218 to function as fuses in the event of seismic loading. The bracing anchors 200 serve to transfer load to the floor and reduce the load that is transferred to the light steel structural member thereby reducing the likelihood of causing premature failure. Strap engagement portion 206 is attached to a strap 218.

Figure 41:
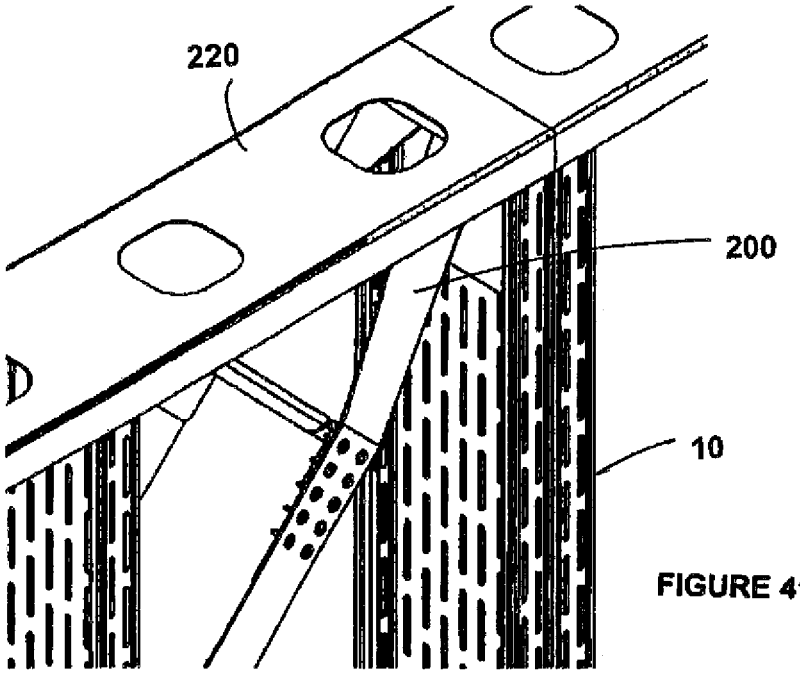
FIG. 41 is a perspective view of a top track that may be used with the light steel structural member of the present embodiment.
Figure 41:
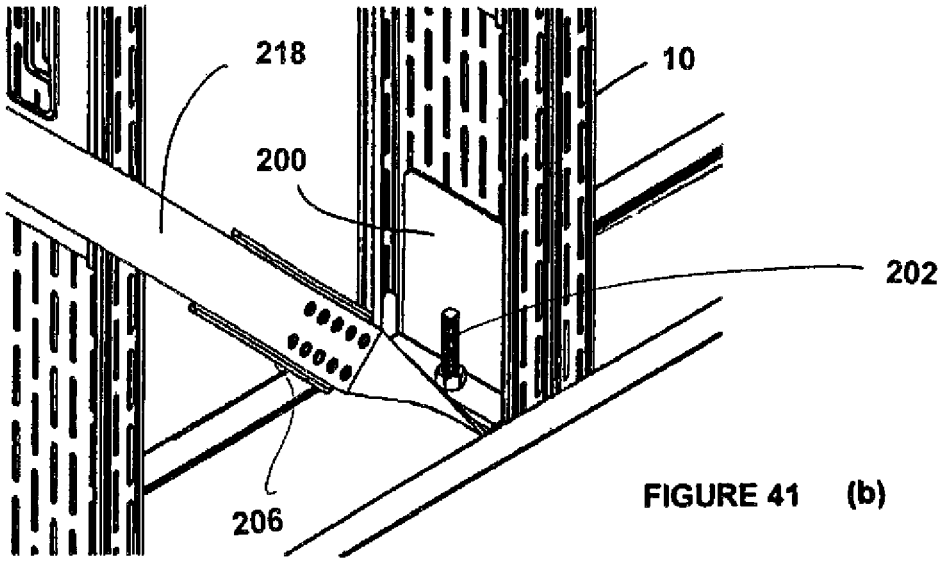
Figure 42:
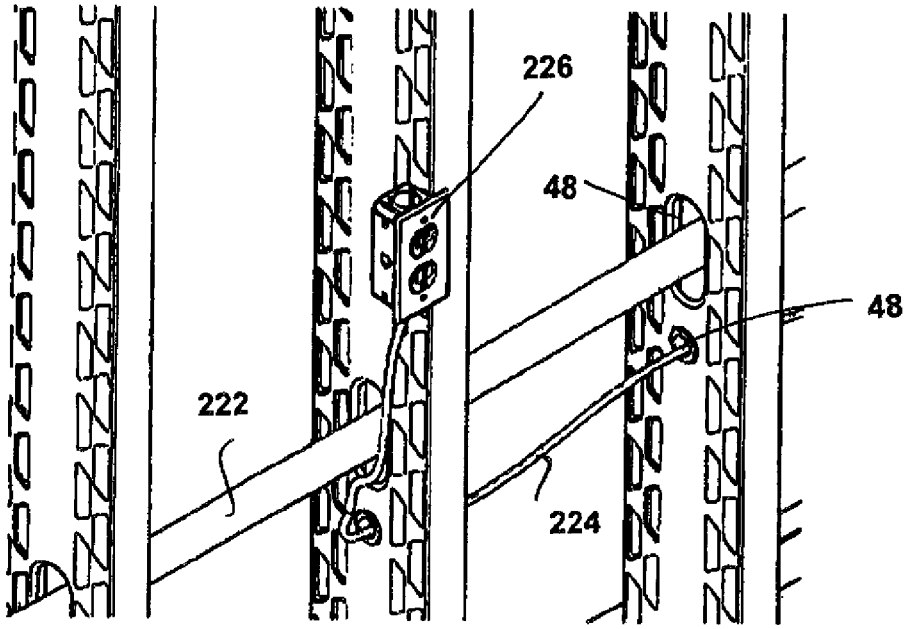
FIG. 42 is a perspective view of a construction detail of the light steel structural member of the present embodiment.
Figure 43:
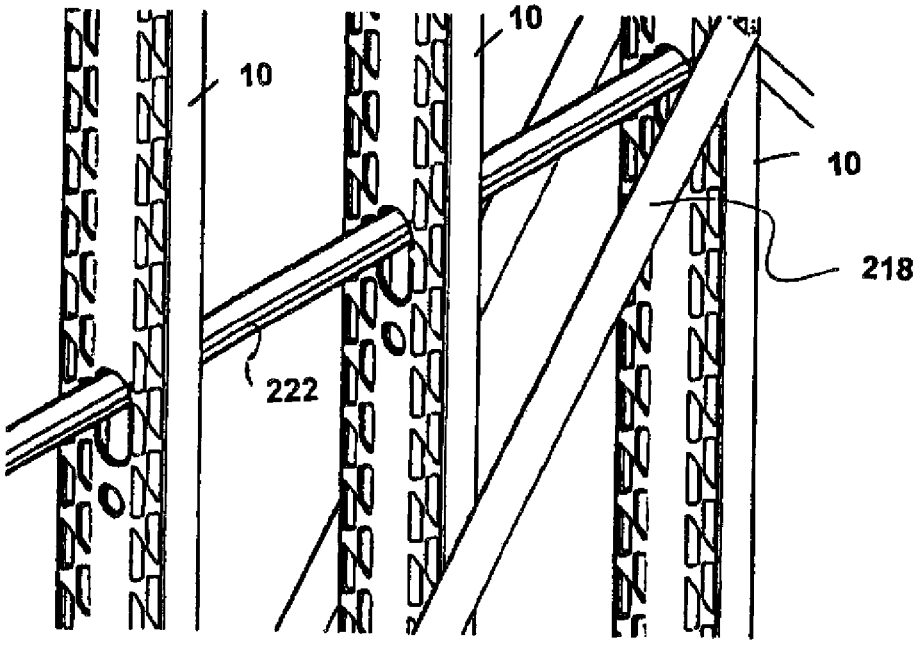
FIG. 43 is a perspective view of another construction detail of the light steel structural member of the present embodiment.
Figure 44:
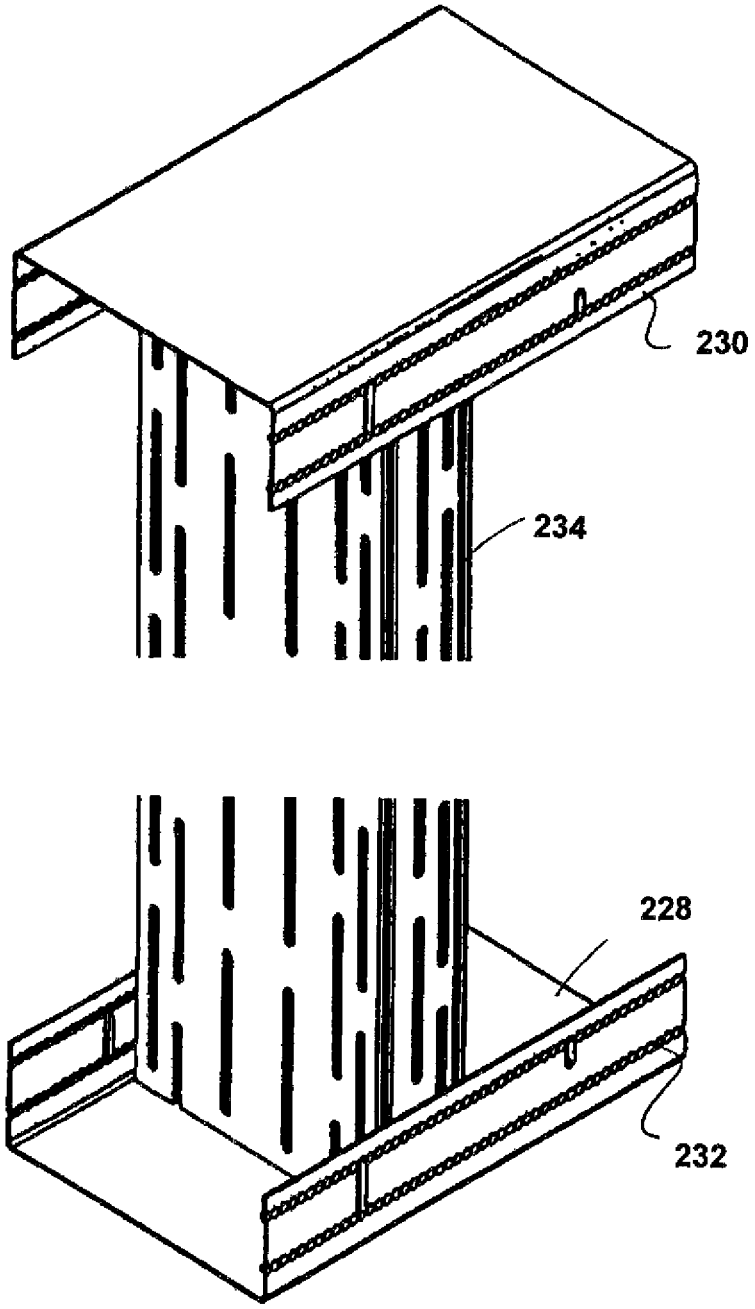
FIG. 44 is a perspective view a light steel structural member positioned in a track.
Figure 45:
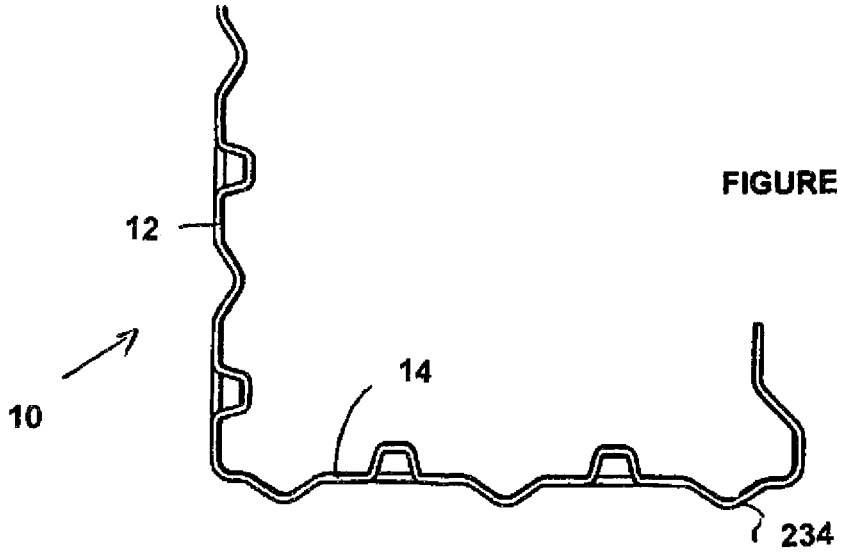
FIG. 45 is a cross sectional view of the light steel structural member showing outwardly projecting ribs.
Figure 46:
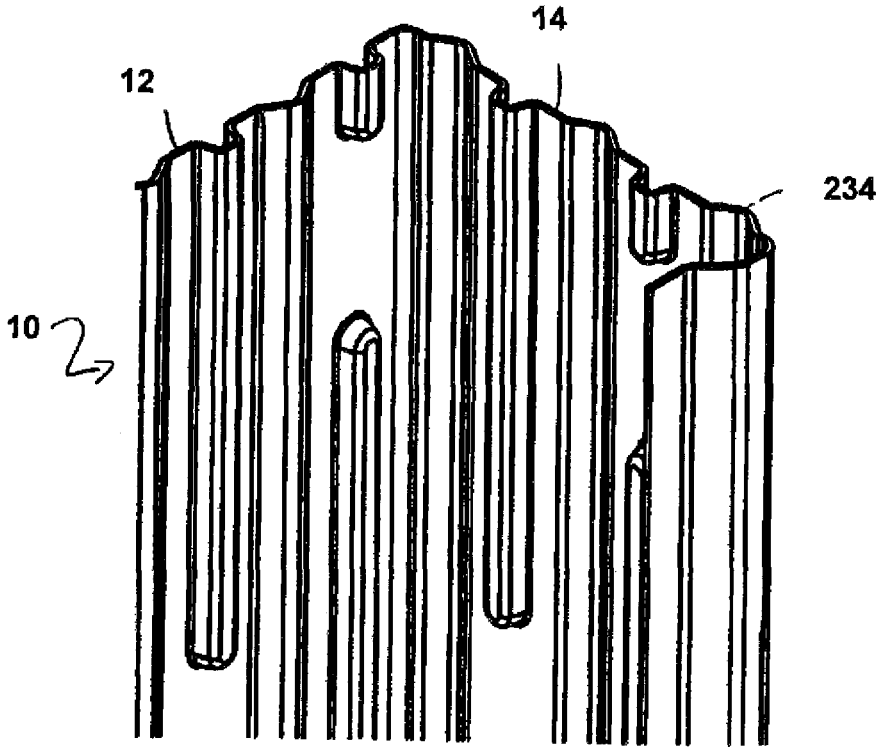
FIG. 46 is an enlarged perspective view of the light steel structural member of FIG. 46.
Figure 47:
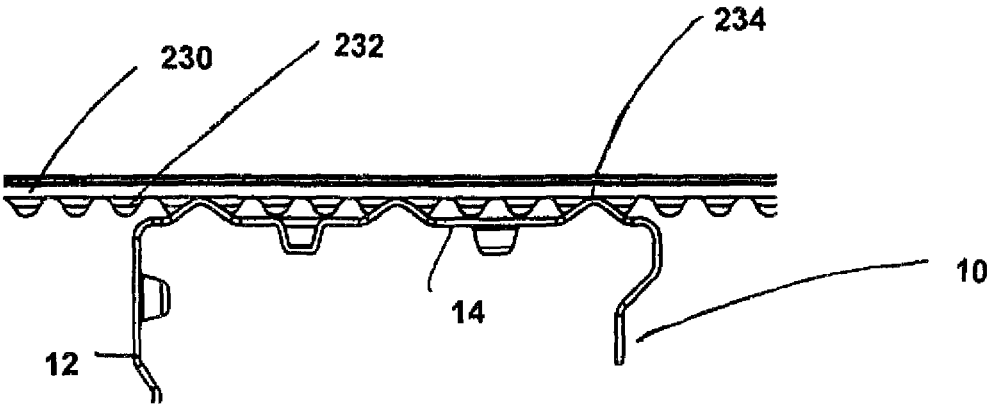
FIG. 47 is a cross sectional view of the light steel structural member of FIG. 46 positioned in a track.

FIGS. 41, 42 and 43 show the light steel structural members 10 in use as studs. A top channel 220 may be attached to the top of the members 10. Pipes 222 may be positioned in the holes 48 and wires 224 may be strung through other holes 48. Electrical sockets 226 may be attached to members 10.

Referring to FIGS. 44 to 47, further features may be added to members 10 to make it easier to install walls using this system. For example the bottom track 228 and top track 230 may include a plurality of alignment dimples 232 extending inwardly into the track. Preferably there are two rows of dimples 232. The dimples 232 are evenly spaced along the track and the dimples in the rows are aligned. The dimples are adapted to engage ribs 234 extending outwardly from flange 14. Preferably ribs 234 are continuous ribs that extend along the length of the structural member 14 and act as restraining ribs 304 described in more detail below.

Figure 48:
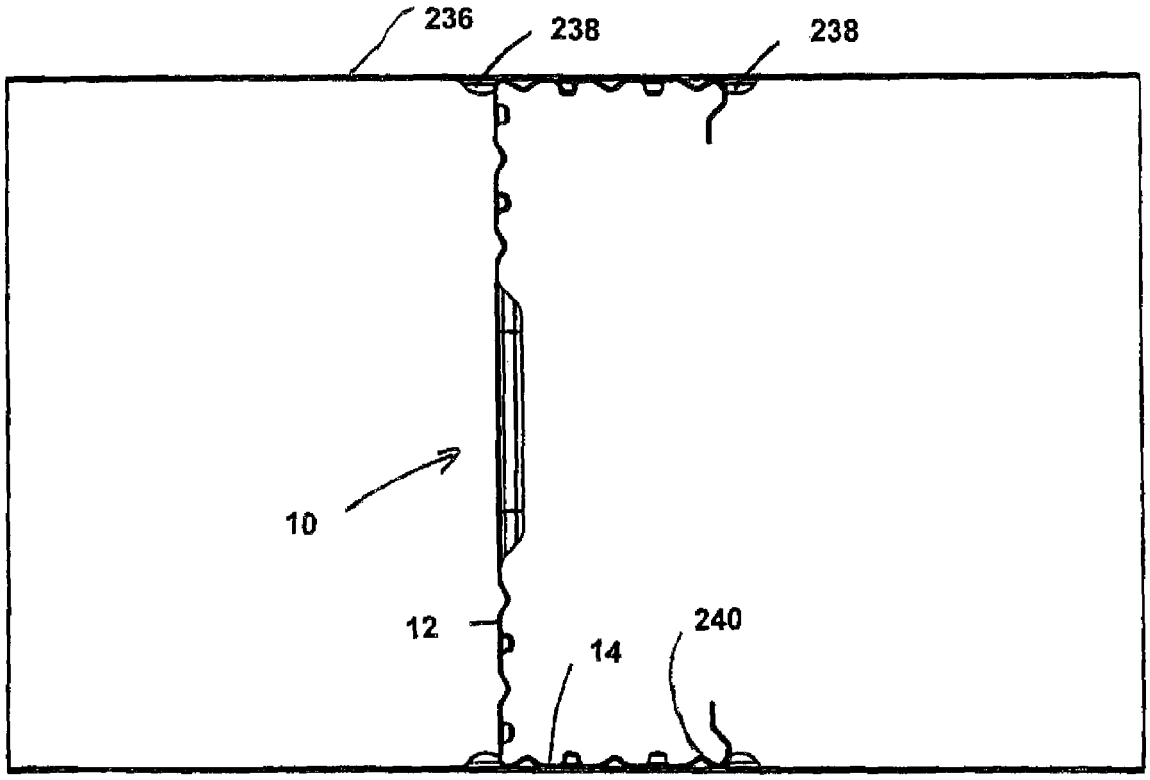
FIG. 48 is a cross sectional view of a light steel structural member showing inwardly projecting ribs positioned in a track used with prior art studs.

The light steel structural members 10 may be adapted to work with prior art tracks as shown in FIG. 48. Prior art tracks 236 have dimples 238 extending inwardly but these dimples 238 are spaced apart with the spacing of the stud. Accordingly the placement of the stud in the track is limited. However, member 10 may be configured to work with this system. Specifically member 10 may be provided with ribs 240 that extend inwardly and embosses that extend inwardly.

Figure 49:
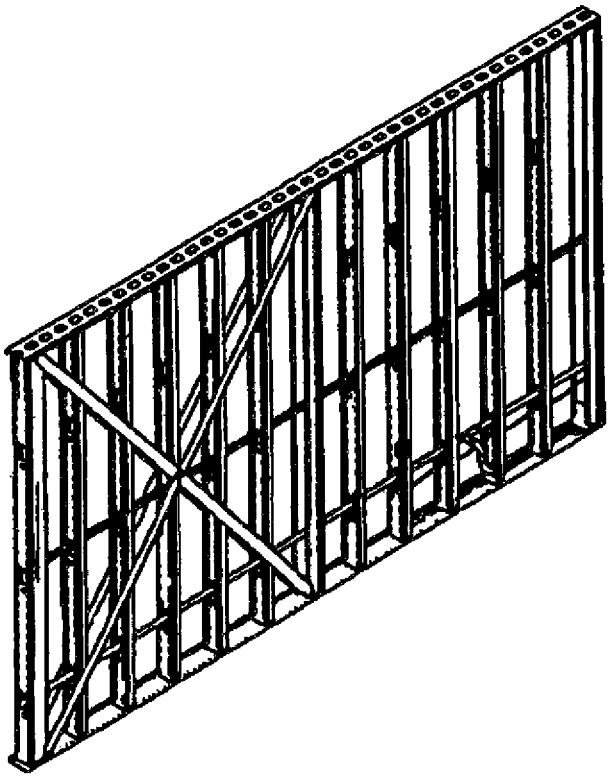
FIG. 49 is a perspective view of the light steel structural member of the present embodiment used in a wall.
Figures 50, 51:
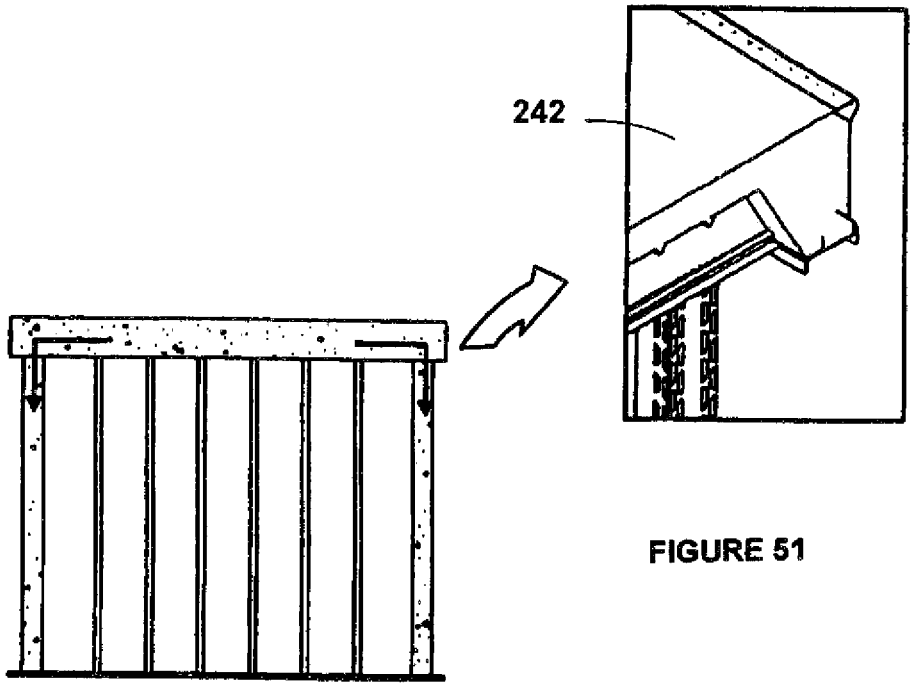
FIG. 50 is a front view with perspective details of the light steel structural member of the present embodiment used in a composite construction.
FIG. 51 is an enlarged perspective view of details of the composite construction shown in FIG. 50.

The light steel structural member 10 of the present embodiment has a number of different applications in which it may be used. Specifically members 10 may be used as studs, floor joists, girts or purlins. The studs may be interior non-load bearing studs, curtain wall studs or axial load bearing studs. The members 10 may be used as composite members wherein concrete is used to fill them up. Two non-limiting examples of the use of member 10 are shown in FIGS. 49, 50 and 51. As can be seen the studs can easily accommodate pipes 222 and wires 224. Further the members 10 can be used as a stay-in-place forming system wherein concrete is poured into the columns and floor at the same time. A detail of the concrete floor 242 is shown in FIG. 51.

It will be appreciated by those skilled in the art that the structural steel members of the present embodiment may be filled with concrete to form structural steel composite members. It will be appreciated by those skilled in the art that other prior art steel members may also be used in this manner to provide an improvement over the members currently in the market. These members either alone or as composite members may be used in a whole construction system in conjunction with floor systems such as COMFLOR™, iSPAN™, and CORESLAB™, C-shaped system, Open Web Steel Joist (OWSJ) system, etc.

Figure 52:
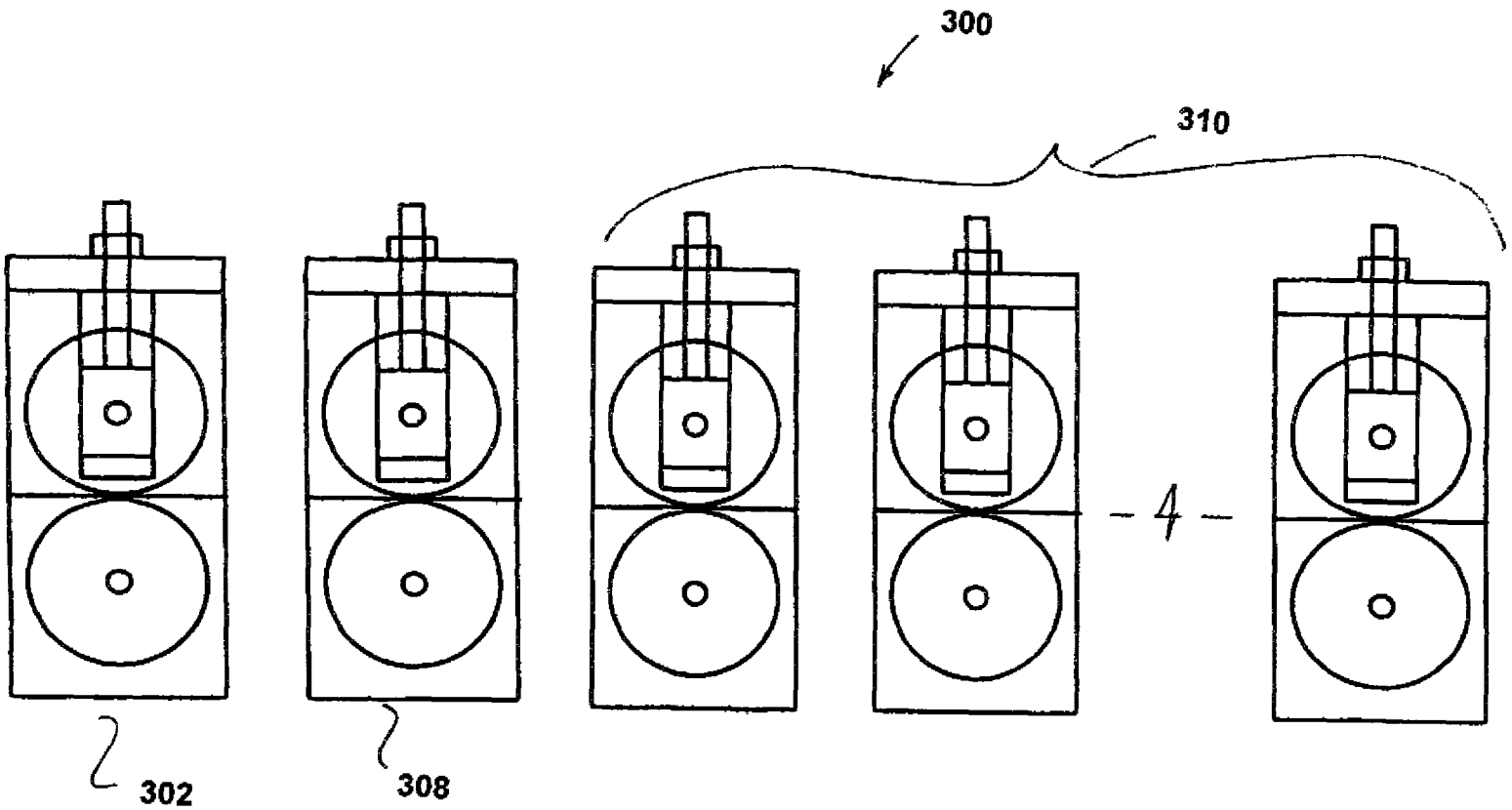
FIG. 52 is a schematic representation of the steps of the roll formed process.
Figure 53:
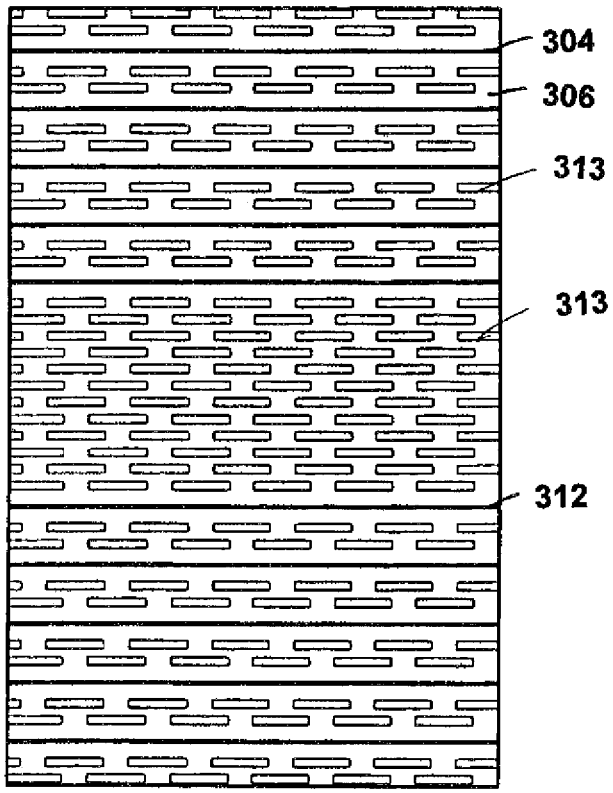
FIG. 53 is a cross sectional view of the sheet metal profile at the first roller stand.
Figure 54:
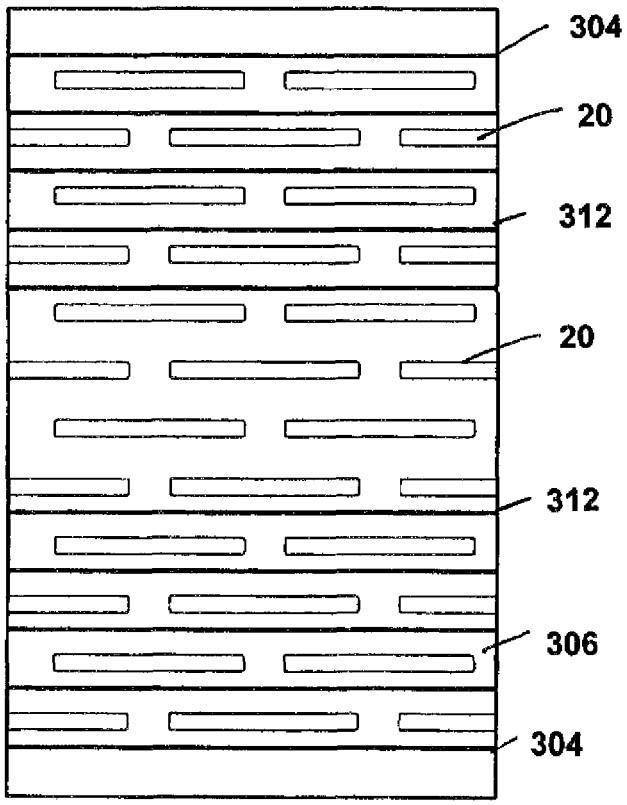
FIG. 54 is a cross sectional view of the sheet metal profile at the second roller stand.
Figure 55:
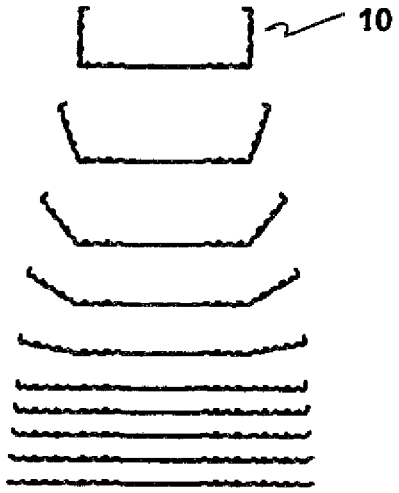
FIG. 55 is a cross sectional view of a plurality of sheet metal profiles of stage three of the process.

Referring to FIG. 52 the system for manufacturing the light steel structural members of the present embodiment is shown generally at 300. Different profiles at the various stages of the roll forming the material into a structural shape are shown in FIGS. 53 to 55. The process can be broken down into three major steps. The first stage 302 is to form at least outer continuous restraining ribs 304 in the sheet material 306 in the first roll forming stand as show in FIG. 53. The second stage 308, in the second stand, is to form surface treatment in the sheet material while restraining the shrinkage with the restraining ribs 304 as shown in FIG. 54. In the embodiment shown in FIG. 54 the surface treatment is embosses 20. The next stage 310 typically will include a plurality of roll forming stands and is to shape the sheet material into the light steel structural member 10 as shown in FIG. 55. In the first step 302 inner continuous restraining ribs 312 may be also formed. As well surface treatments such as light embosses, knurling or etching may also be formed in the first stand. The advantage of the restraining ribs is that they restrain the sheet material during the embossing/surface treatment operation so the material is stretched. Omitting the restraint ribs results in extra material being used/absorbed during the process. Utility holes may be punched into the sheet metal at any convenient stage in the process. For example, they may be prepunched or punched at a later stage.

The surface treatment may include knurling, embosses and a combination of both. As well the surface treatment may include punching holes into the sheet metal to provide holes for utilities and to provide engagement holes. Thereafter the sheet metal is shaped into the desired embodiment of the light steel sheet member 10. Using a conventional cold rolling mill, the rollers on the conventional mill will have grooves to accommodate passing of the embossed material without damaging the embossments There are a number of advantages that are provided by the different embodiments of the present embodiment. Specifically, for the light steel frame C-Section, strategically located continuous stiffeners arranged in the longitudinal direction of the member provides increased load carrying capacity, however placing continuous stiffeners uses more material. So the cost of adding stiffeners by adding material to increase capacity may negate the cost advantages for the introduction of the stiffeners. This embodiment provides non-continuous-stiffeners (embossments) that in effect provide continuous stiffening of the surfaces without the need of using additional materials.

Figure 56:
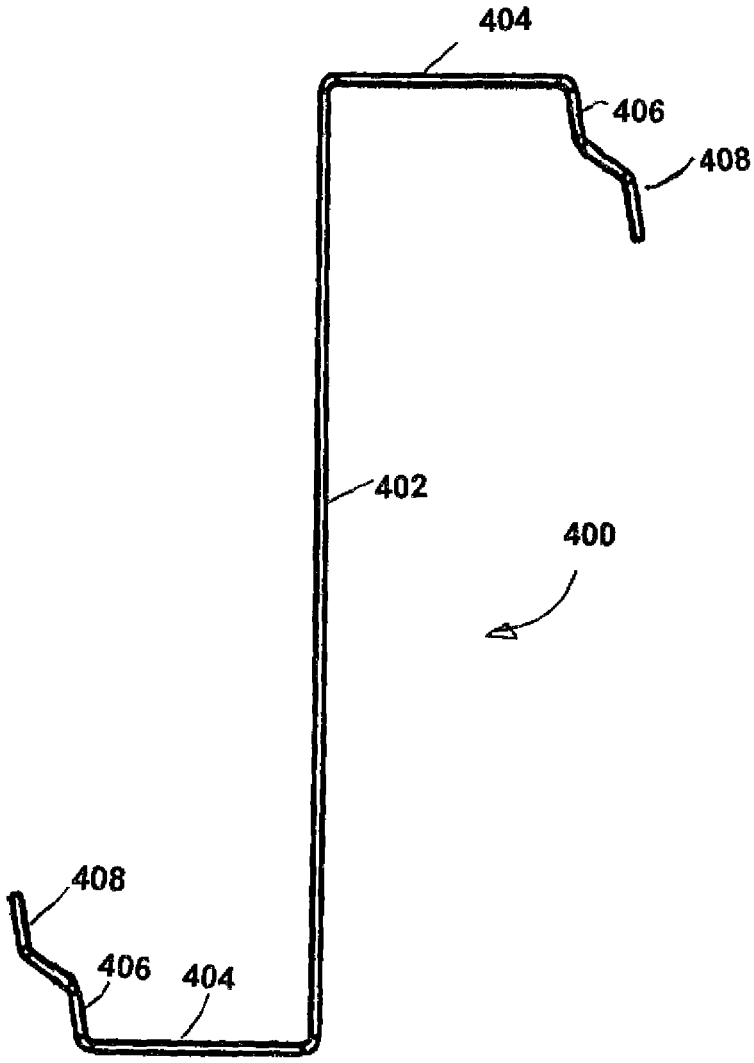
FIG. 56 is a cross sectional view of a Z-shaped embodiment of the light steel structural member of the present embodiment.
Figure 57:
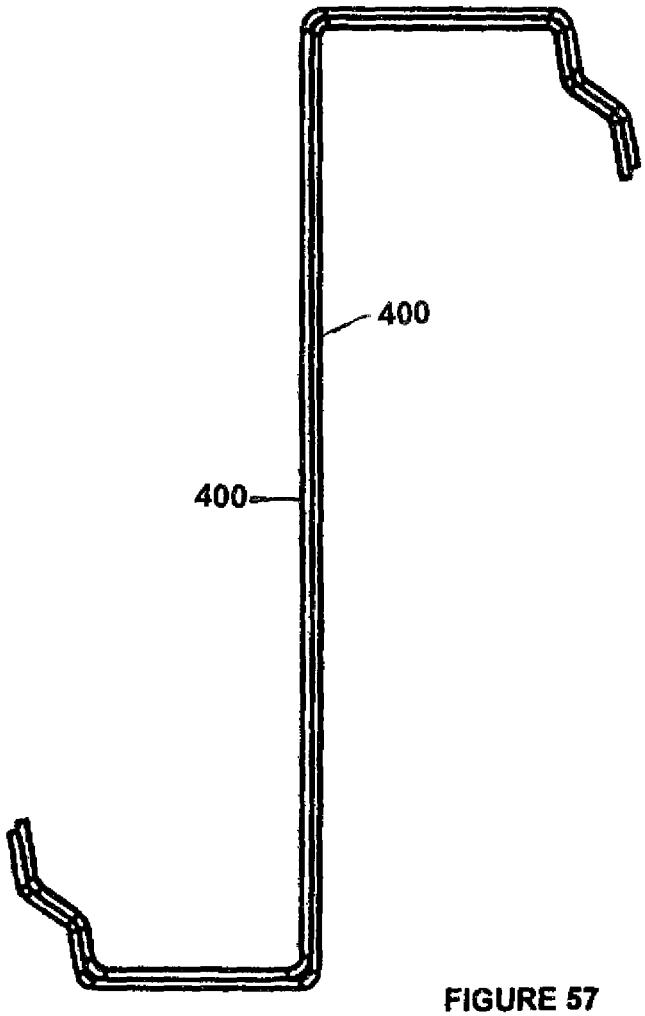
FIG. 57 is a cross sectional view similar to that of FIG. 56 showing two Z-shaped members nested together.

It will be appreciated by those skilled in the art that while the embodiments of the embodiment have generally described in regard to C-shaped members the techniques may be applied to other shaped light steel structural members. For example Z-shaped members may also be used as shown in FIGS. 56 and 57. In this embodiment the multi-cranked stiffener is shown with a Z-shaped member 400. The Z-shaped member includes a web portion 402 and a pair of flange portions 404 extending outwardly from the web portion. A pair of lips 406 extend inwardly, one from the end of each flange portion. A pair of multi-cranked stiffeners 408 extend from the lips 406.

To increase the utility of this embodiment for the LSF industry the inventors use a mass-customization strategy to develop wall systems using the new structural member to better satisfy user needs. Mass-customization considered in the design phase allows a product to be developed that includes: end user needs, building science needs, structural needs, reduced assembly time needs and reduction in overall costs of the assembly. The structural member has indentations, holes and stiffeners that satisfy utility needs.

The indentation in the flanges provides an envelop of space wherein a concrete filled steel column has utility to install sheathing fasteners.

The embossments provide reduced contact area between the wall member and the gypsum or wood sheathing; this reduces temperature conductivity of the wall system.

The utility hole punched in the web is reinforced with a lip. This hole will be punched after and over the non-continuous stiffeners. Non-continuous stiffeners combined with a stiffened hole provide a structural member that is continuously reinforced throughout its length. The unique flattened surface in the hole reinforcements provide utility for attaching standard bracing and for providing utility holes for attaching bridging in a simple manner.

Using the embossments the structural member has been developed to provide a composite steel/concrete member. This type of member provides increased structural capacity and increased fire resistance.

"Light steel" framing refers to members with relatively thin walls with respect to the width of each element. In a typical C Section, the flat elements are referred to as the web, flanges, and lips. Since the element widths are large with respect to their wall thickness, they have a tendency to buckle locally at compressive stress levels lower than the yield strength. One way of interpreting this phenomenon is that the section is not fully efficient, or "effective", since the full strength of the material is not reached when the ultimate load of the member is achieved.

To date, single or multiple intermediate stiffeners have been used continuously along the length of a member to reduce the width to thickness ratio of the flat elements of a cross section. The ribs or stiffeners increase the bending stiffness of the plate, thus reducing the effects of local buckling across the width of the originally flat element. However, the introduction of intermediate stiffeners increases amount of material required to achieve the same overall dimensions of a member without the intermediate stiffeners.

This embodiment has "effective" intermediate stiffeners comprised of spaced embossments, in single or in multiple rows. The embossments are pressed into the flat elements in such a manner that extra coil width is not required. Instead elongation of the sheet material occurs. The "effective" intermediate stiffeners increase the bending stiffness of flat elements in the same manner as the continuous intermediate stiffeners, thereby increasing the efficiency or effectiveness of the member's cross section. The introduction of the embossments thus results in stronger compression or flexural members with the same weight as a member without the embossments. As a corollary, one can say that the addition of the embossments results in the same strength with less material weight with respect to a member without the embossments.

The standard C Section is made up of a web, flanges, and lips. The lips are bound only by a bend on one side, and are thus referred to as unstiffened compression elements since they are free to buckle locally throughout most of their width when subjected to a compressive stress. Besides the strength they provide to the overall member, the wings provide stiffening of the flange against distortional buckling. The effects of local buckling reduce the overall effectiveness of the lip to stiffen the flange against distortional buckling.

This embodiment provides a 90° stiffener added to the lip to increase the lips' plate buckling stiffness, thus reducing the effects of local buckling. With the appropriate apportioning of materials, the moment of inertia of the lip and lip stiffener combination can be made larger than that of a lip alone, thus increasing its ability to stiffen the flange against distortional buckling. The result of increased local and distortional buckling resistance is increased member strength for the same weight. As a corollary, one can say that the addition of a stiffener to the lip can result in the same strength with less material than a similar section without the lip stiffener.

Generally speaking, the systems described herein are directed to light steel structural members, system for their use, and a method of making them. As required, embodiments of the present embodiment are disclosed herein. However, the disclosed embodiments are merely exemplary, and it should be understood that the embodiment may be embodied in many various and alternative forms. The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present embodiment. For purposes of teaching and not limitation, the illustrated embodiments are directed to light steel structural members, system for their use a method of making them.

As used herein, the terms "comprises" and "comprising" are to be construed as being inclusive and opened rather than exclusive. Specifically, when used in this specification including the claims, the terms "comprises" and "comprising" and variations thereof mean that the specified features, steps or components are included. The terms are not to be interpreted to exclude the presence of other features, steps or components.

It will be appreciated that the above description related to the embodiment by way of example only. Many variations on the embodiment will be obvious to those skilled in the art and such obvious variations are within the scope of the embodiment as described herein whether or not expressly described.

What is claimed is:

1. A light steel structural stud comprising:

a unitary piece of sheet material formed into a generally C-shaped stud having a pair of distal end portions along a longitudinal axis, the sheet material stud having:

a web portion having a web face and sides;

a pair of flange portions each extending generally orthogonally from each side of the web portion, each flange portion being in a plane that is generally parallel to the plane of the other flange portion, each of the flange portions having a flange face;

a pair of flange lips each extending generally orthogonally from each of the flange portions and being generally parallel to and spaced from the web portion; and wherein each flange lip and each flange portion has a double thickness formed by folding the sheet material at each flange lip so as to have two closely adjacent and parallel wall portions forming each flange portion and each distal end portion being in continuous contact with the web portion and the distal end portions being spaced apart such that at least a central portion of the web portion does not have a double thickness and wherein the stud is substantially symmetrical around the central Portion of the web.

2. The light steel structural stud as claimed in claim 1 wherein the double thickness is on the outside of the stud.

3. The light steel structural stud as claimed in claim 1 wherein the double thickness is on the inside of the stud.

4. The light steel structural stud as claimed in claim 1 further including a pair of lip stiffeners, each extending generally orthogonally from each of the lips and being generally parallel to the flange portions and wherein the lip stiffeners have a double thickness.

5. The light steel structural stud as claimed in claim 1 wherein the double thickness is arranged such that there is provided hollow portions.

6. The light steel structural stud as claimed in claim 5 wherein the hollow portion is at each corner between the flange portion and web portion.

7. The light steel structural stud as claimed in claim 5 wherein the hollow portion is at a corner between each flange portion and the flange lip.

8. The light steel structural stud as claimed in claim 5 wherein the hollow portion is defined by the double thickness of the lip being spaced apart.

9. The light steel structural stud as claimed in claim 1 further including a multi-cranked stiffener extending from each of the flange lips.

10. The light steel structural stud as claimed in claim 9 wherein the multi-cranked stiffener includes a first portion extending from the flange lips and a second portion extending from the first portion.

11. The light steel structural stud as claimed in claim 10 wherein the first portion is generally orthogonal to the flange lips and extends inwardly from the flange lips.

12. The light steel structural stud as claimed in claim 11 wherein the second portion extends generally orthogonally from the first portion and towards the flange portion.

13. The light steel structural stud as claimed in claim 11 wherein the second portion extends generally orthogonally from the first portion and away from the flange portion.

14. The light steel structural stud as claimed in claim 10 wherein the first portion is generally orthogonal to the flange lips and extends outwardly therefrom and the second portion extends generally orthogonally from the first portion and away from the flange portion.

15. The light steel structural stud as claimed in claim 10 wherein the first portion is angled outwardly from the flange lips, the flange lips each having a plane, and the second portion extends away from the flange portion in a plane generally parallel to the plane of the flange lips.

16. The light steel structural stud as claimed in claim 10 wherein the first portion is angled generally inwardly from the flange lips, the flange lips each having a plane, and the second portion extends away from the flange in a plane generally parallel to the plane of the flange lips.

17. The light steel structural stud as claimed in claim 1 further including a utility hole.

18. The light steel structural stud as claimed in claim 17 wherein the utility hole is over punched.

19. The light steel structural stud as claimed in claim 1 wherein each of the flange portions has a width that is less than the width of the web portion.

20. The light steel structural stud as claimed in claim 1 wherein each of the flange portions has a width that is generally the same as the width of the web portion.

21. The light steel structural stud as claimed in claim 1 wherein each of the flange portions has a width that is greater than the width of the web portion.

22. The light steel structural stud as claimed in claim 1 wherein each of the flange portions has a web end portion and an indent portion and the indent portion is spaced inwardly from the web end portion.

23. The light steel structural stud as claimed in claim 22 wherein the indent portion forms a small indent.

24. The light steel structural stud as claimed in claim 22 wherein the indent portion forms a large indent.

25. The light steel structural stud as claimed in claim 1 wherein each of the flange portions has a generally rectangular groove formed therein.

26. The light steel structural stud as claimed in claim 1 wherein the light steel structural stud further includes a volume of concrete to form a composite member.

27. The light steel structural stud as claimed in claim 1 further including a pair of restraining ribs, each extending from one of the pair of flange portions proximate to an edge of the flange portions.

28. The light steel structural stud as claimed in claim 27 further including a plurality of inner restraining ribs.

29. The light steel structural stud as claimed in claim 1 wherein the flange lips extend inwardly.

30. The light steel structural stud as claimed in claim 1 wherein the flange lips extend outwardly.

31. The light steel structural stud as claimed in claim 1 further including surface treatment formed in at least one of the web portion and the flange portions.

32. The light steel structural stud as claimed in claim 31 wherein the surface treatment is selected from a group consisting of knurling, etching, small embosses, embosses and a combination thereof.

33. A light steel system comprising a plurality of light steel structural studs as claimed in claim 1.

34. The light steel system as claimed in claim 33 further including a top track extending over the plurality of studs.

35. The light steel system as claimed in claim 34 wherein the track has a plurality of holes formed therein.

36. The light steel system as claimed in claim 33 further including a composite floor system.

37. The light steel system as claimed in claim 33 further including a bridging member.

38. The light steel system as claimed in claim 37 wherein the bridging member has stud engagement fingers and a stabilizing tongue at one end thereof, and a bridge engagement portion at the other end thereof.

39. The light steel system as claimed in claim 33 further including batons.

40. The light steel system as claimed in claim 33 further including strap bracings.

41. The light steel system as claimed in claim 33 further including tracks with dimples and outwardly extending ribs.

42. The light steel system as claimed in-claim 33 further including tracks with inwardly extending ribs.

* * * * *